US011286438B2

(12) United States Patent
Snaith et al.

(10) Patent No.: US 11,286,438 B2
(45) **Date of Patent: *Mar. 29, 2022**

(54) FUEL OIL / PARTICULATE MATERIAL SLURRY COMPOSITIONS AND PROCESSES

(71) Applicant: ARQ IP Limited, London (GB)

(72) Inventors: Paul Snaith, Kent (GB); John Francis Unsworth, Wrexham (GB)

(73) Assignee: Arq IP Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/082,678

(22) PCT Filed: Apr. 4, 2017

(86) PCT No.: PCT/GB2017/050938

§ 371 (c)(1),
(2) Date: Sep. 6, 2018

(87) PCT Pub. No.: WO2017/174972

PCT Pub. Date: Oct. 12, 2017

(65) Prior Publication Data

US 2019/0119592 A1 Apr. 25, 2019

Related U.S. Application Data

(63) Continuation of application No. 15/284,995, filed on Oct. 4, 2016, now Pat. No. 9,777,235.

(30) Foreign Application Priority Data

| | | |
|---|---|---|
| Apr. 4, 2016 | (GB) | 1605768 |
| Apr. 29, 2016 | (GB) | 1607557 |
| Nov. 23, 2016 | (CN) | 201611044116.0 |

(51) Int. Cl.
*C10L 1/32* (2006.01)

(52) U.S. Cl.
CPC ..... *C10L 1/322* (2013.01); *C10L 2200/043* (2013.01); *C10L 2200/0438* (2013.01);
(Continued)

(58) Field of Classification Search
CPC ..... C10L 1/322; C10L 2200/043; C10L 2200/0438; C10L 2230/14; C10L 2250/06;
(Continued)

(56) References Cited

U.S. PATENT DOCUMENTS

| | | | |
|---|---|---|---|
| 1,329,493 | A | 2/1920 | Bacon et al. |
| 2,590,733 | A | 3/1952 | Stillman |

(Continued)

FOREIGN PATENT DOCUMENTS

| | | | |
|---|---|---|---|
| CA | 1096620 | A | 6/1926 |
| CA | 1096620 | | 3/1981 |

(Continued)

OTHER PUBLICATIONS

Grimanis, Breault, Smit, and Jha; Storage, transportation, and atomization of CWF for residential applications. Final report, Sep. 27, 1989-Nov. 15, 1991, pp. 1-153, retrieved from : https://www.osti.gov/biblio/10112838-storage-transportation-atomization-cwf-residential-applications-final-report-september-november.

(Continued)

*Primary Examiner* — Cephia D Toomer
(74) *Attorney, Agent, or Firm* — Dinsmore & Shohl LLP

(57) ABSTRACT

This document relates to a fuel oil composition comprising: (i) a solid hydrocarbonaceous and/or solid carbonaceous material, wherein the material is in particulate form, and wherein at least about 90% by volume (% v) of the particles are no greater than about 20 microns in diameter; and (ii) a liquid fuel oil; wherein the solid hydrocarbonaceous and/or solid carbonaceous material is present in an amount of at (Continued)

most about 30 by mass (% m) based on the total mass of the fuel oil composition. The invention further relates a process for the preparation of this fuel oil composition, a method of changing a grade of a liquid fuel oil, and a method for adjusting the flash point of a liquid fuel oil.

32 Claims, 7 Drawing Sheets

(52) U.S. Cl.
CPC ..... *C10L 2230/14* (2013.01); *C10L 2250/06* (2013.01); *C10L 2290/02* (2013.01); *C10L 2290/08* (2013.01); *C10L 2290/24* (2013.01); *C10L 2290/28* (2013.01); *C10L 2290/34* (2013.01); *C10L 2290/54* (2013.01)

(58) Field of Classification Search
CPC ..... C10L 2290/02; C10L 2290/08; C10L 2290/24; C10L 2290/28; C10L 2290/34; C10L 2290/54
See application file for complete search history.

(56) References Cited

U.S. PATENT DOCUMENTS

| | | | | |
|---|---|---|---|---|
| 2,754,267 | A | | 7/1956 | Bondi |
| 3,327,402 | A | | 6/1967 | Lamb et al. |
| 4,090,853 | A | | 5/1978 | Clayfield et al. |
| 4,239,426 | A | | 12/1980 | Shozo et al. |
| 4,251,229 | A | * | 2/1981 | Naka ..... C10L 1/322 44/281 |
| 4,255,155 | A | | 3/1981 | Frankovich |
| 4,265,637 | A | | 5/1981 | Anderson |
| 4,282,004 | A | | 8/1981 | Masologites |
| 4,306,883 | A | | 12/1981 | Eckman |
| 4,309,269 | A | | 1/1982 | Denker et al. |
| 4,319,980 | A | * | 3/1982 | Jenkins ..... C10G 1/04 203/66 |
| 4,330,300 | A | | 5/1982 | Cairns |
| 4,334,976 | A | | 6/1982 | Yan |
| 4,358,293 | A | | 11/1982 | Mark |
| 4,377,392 | A | | 3/1983 | Massey et al. |
| 4,382,001 | A | | 5/1983 | Kulprathipanja et al. |
| 4,389,219 | A | | 6/1983 | Naka et al. |
| 4,396,397 | A | | 8/1983 | Kugel et al. |
| 4,417,901 | A | | 11/1983 | Ando et al. |
| 4,420,445 | A | | 12/1983 | Yamamoto et al. |
| 4,425,135 | A | | 1/1984 | Jenkins |
| 4,459,762 | A | | 7/1984 | Hardesty et al. |
| 4,511,364 | A | | 4/1985 | Mitsumori |
| 4,537,599 | A | | 8/1985 | Greenwald, Sr. |
| 4,552,725 | A | | 11/1985 | Audeh |
| 4,671,801 | A | | 6/1987 | Burgess et al. |
| 4,780,110 | A | | 10/1988 | Beshore |
| 4,783,198 | A | | 11/1988 | Hueschen |
| 4,859,209 | A | | 8/1989 | Szabo nee Mogyorossi et al. |
| 4,900,429 | A | | 2/1990 | Richardson |
| 5,096,461 | A | | 3/1992 | Frankiewicz et al. |
| 5,242,470 | A | | 9/1993 | Salter et al. |
| 5,379,902 | A | | 1/1995 | Wen et al. |
| 5,503,646 | A | | 4/1996 | McKenny et al. |
| 5,902,359 | A | | 5/1999 | Grosso et al. |
| 6,083,286 | A | | 7/2000 | Ono |
| 6,767,465 | B1 | | 7/2004 | Choung et al. |
| 6,793,079 | B2 | | 9/2004 | Khan et al. |
| 7,431,744 | B2 | | 10/2008 | Sugita et al. |
| 7,537,700 | B2 | | 5/2009 | Kanda et al. |
| 8,177,867 | B2 | | 5/2012 | Joseph et al. |
| 8,591,607 | B2 | | 11/2013 | Fleming et al. |
| 8,610,071 | B2 | | 12/2013 | Kamba et al. |
| 9,328,920 | B2 | | 5/2016 | Sirdeshpande et al. |
| 9,777,235 | B2 | | 10/2017 | Snaith et al. |
| 2007/0028509 | A1 | | 2/2007 | Dobbs et al. |
| 2010/0287828 | A1 | | 11/2010 | Flemming et al. |
| 2011/0174696 | A1 | | 7/2011 | Young et al. |
| 2011/0239973 | A1 | | 10/2011 | Qin |
| 2012/0167457 | A1 | | 7/2012 | Harsh et al. |
| 2012/0177923 | A1 | | 7/2012 | Kumara |
| 2012/0317878 | A1 | | 12/2012 | Taulbee |
| 2013/0152453 | A1 | | 6/2013 | Baird et al. |
| 2014/0054503 | A1 | * | 2/2014 | Liu ..... C10L 1/326 252/373 |
| 2015/0184099 | A1 | | 7/2015 | Swensen et al. |
| 2016/0082446 | A1 | | 3/2016 | Swensen et al. |
| 2016/0160141 | A1 | | 6/2016 | Sakaguchi et al. |
| 2018/0134977 | A1 | | 5/2018 | Swensen et al. |

FOREIGN PATENT DOCUMENTS

| | | | | |
|---|---|---|---|---|
| CA | 1109820 | | | 9/1981 |
| CN | 1354227 | | * | 6/2002 |
| CN | 1354227 | A | | 6/2002 |
| CN | 101245918 | A | | 8/2008 |
| CN | 101397514 | A | | 4/2009 |
| CN | 10649220 | A | | 2/2010 |
| CN | 101649220 | A | | 2/2010 |
| CN | 101735871 | A | | 6/2010 |
| CN | 102434343 | A | | 5/2012 |
| CN | 105567321 | A | | 5/2016 |
| CN | 108148610 | A | | 6/2018 |
| DE | 284128 | A1 | | 5/1979 |
| DE | 2849128 | A1 | | 5/1979 |
| DE | 2849124 | A1 | | 5/1980 |
| DE | 3130662 | A1 | | 8/1981 |
| DE | 3130662 | A1 | | 2/1983 |
| DE | 3200240 | A1 | | 7/1983 |
| EP | 0012606 | A | | 12/1979 |
| EP | 0012606 | A1 | | 12/1979 |
| EP | 42727 | A2 | | 12/1981 |
| EP | 0062220 | A2 | | 10/1982 |
| EP | 0105236 | A2 | | 4/1984 |
| EP | 3438048 | A1 | | 2/2019 |
| FR | 2595711 | A1 | | 11/1982 |
| GB | 2164271 | A | | 3/1986 |
| JP | 53117002 | A | | 10/1978 |
| JP | S53117002 | A | | 10/1978 |
| JP | 5440808 | A | | 3/1979 |
| JP | S5440808 | A | | 3/1979 |
| JP | 54129008 | A | | 10/1979 |
| JP | S54129008 | A | | 10/1979 |
| JP | 56036589 | A | | 4/1981 |
| JP | S5636589 | A | | 4/1981 |
| JP | 57098595 | A | | 6/1982 |
| JP | 62172093 | A | | 7/1987 |
| JP | S62172093 | A | | 7/1987 |
| JP | 6348396 | A | | 3/1988 |
| JP | S6348396 | A | | 3/1988 |
| JP | 200290673 | A | | 10/2000 |
| JP | 2002290673 | A | | 10/2002 |
| JP | 5582192 | B2 | | 9/2014 |
| JP | 5730795 | B2 | | 6/2015 |
| JP | 5780484 | B2 | | 9/2015 |
| RU | 1838384 | C | | 8/1993 |
| RU | 2541322 | C1 | | 2/2015 |
| WO | 2010039315 | A2 | | 4/2010 |
| WO | 2011084730 | A1 | | 7/2011 |
| WO | 2015187450 | A2 | | 12/2015 |
| WO | 2017166920 | A1 | | 10/2017 |
| WO | 2017174973 | A1 | | 10/2017 |

OTHER PUBLICATIONS

Zhichao, L; Yanyan, H; Yawen, D; Ultra-clean coal's laboratory investigation for the coal preparation plant of Taixi, pp. 1-10, retrieved from http://www.paper.edu.cn/releasepaper/content/201003-1050.

U.S. Non-Final Office Action issued in U.S. Appl. No. 15/981,362 dated Sep. 21, 2018.

U.S. Non-Final Office Action issued in U.S. Appl. No. 15/981,372 dated Sep. 6, 2018.

(56) References Cited

OTHER PUBLICATIONS

U.S. Non-Final Office Action issued in U.S. Appl. No. 15/981,372 dated Sep. 20, 2019, 15 pages.
Search Report pertaining to corresponding Great Britain Patent Application No. GB1815791.7, dated Mar. 1, 2019.
Examination Report pertaining to corresponding Russian Patent Application No. 2018123758/04(037656), dated Jan. 25, 2019.
Examination Report pertaining to corresponding Russian Patent Application No. 2018123748/04(037645), dated Jan. 25, 2019.
Wibberly et al., "Premium Coal Fuels with Advanced Coal Beneficiation", 40th Interational Technical Conference Clean Coal & Fuel Systems, May 31-Jun. 4, 2015, Sheraton Sand Key, Clearwater, Florida, USA.
Grimanis et al., "Storage, transportation, and atomization of CWF for residential applications", Final Report, Sep. 27, 1989-Nov. 15, 1991, pp. 1-153, retrieved from https://www.osti.gov/biblio/101128538-storage-transportation-atomization-cwf-residential-applications-final-report-september-november.
Bartle et al., "Co-Refining of Coal and Petroleum", Commission of the European Communities, Energy, 1991.
British Coal Corporation, "Improvement to Direct Coal Liquefaction", European Commission, Technical Coal Research, 1999.
Curtis et al., Evaluation of Process Parameters for Combined Processing of Coal with Heavy Crudes and Residua, Ind. Eng. Che., Process Des. Dev., 1985, 1259.
Examination Report pertaining to Indian Application No. 201817029523 dated Jun. 26, 2020.
Examination Report pertaining to Colombian Application No. 20189998147 dated Jun. 18, 2020.
Office Action pertaining to Chinese Application No. 20161104416.0 dated Jun. 19, 2020.
International Search Report and Written Opinion dated Feb. 6, 2020 for Application No. PCT/GB2019/052738 filed Sep. 27, 2019.
Cui et al., "A Novel Process for Preparation of an Ultra-Clean Superfine Coal-Oil Summary", Fuel, 2008, 87, 2296-2303.
Shaver, Robert G., "A Solvent-Refined Coal Process for Clean Utility Fuel", Advances in Chemistry Series, 1974, 127, 89-90.
Clayfield, E et al., "Colloil Manufacture and Application", Fuel, 1981, 60, 865.
Nunez, G.A., et al., Colloidal Coal in Water Suspensions (Energy and Environmental Science, 2010, 3(5), 629.
Osborne et al., "Two Decades of Jameson Cell Installations in Coal", 17th International Coal Preparation Congress, Instanbul, 1-6, Oct. 2013.
Great Britain Search Report pertaining to Application No. GB1607557.4 dated Oct. 13, 2016.
Baek Se Hyun et al., "The Effect of the Coal Blending Method in a Coal Fired Boiler on Carbon in Ash and N0x Emission", Fuel, IPC Science and Technology Press Guildford, GB, vol. 128, Mar. 6, 2014, pp. 62-70.
Indonesia Office Action pertaining to Application No. HKI-3-HI.05.02.01.PID201804937-TA dated Oct. 21, 2020 with English Translation.
China Office Action pertaining to Application No. 2017800112831 dated Oct. 30, 2020 with English Translation.
Japan Office Action pertaining to Application No. 2018-539158 dated Nov. 17, 2020 with English Translation.
Jing et al., "Preparation of Slurry with Colloid Mill and the Effect of the Particle Size of Coal on Direct Liquefaction Properties of the Oil", Coal Conversion, vol. 37, Issue 2, pp. 28-32, Apr. 2014.
Office action pertaining to Australia Application No. 2017246679 dated Jul. 31, 2020.
Office action pertaining to Australia Application No. 20172466780 dated Jul. 30, 2020.
Office Action pertaining to Japanese Application No. 2018-539158 dated Aug. 2, 2011.
Office Action pertaining to Indonesia Application No. PID201804912 dated Aug. 24, 2020.
Office Action pertaining to Japanese Application No. 2018-539146 dated Aug. 2, 2018.
Office Action pertaining to India Application No. 201817029522 dated Jul. 24, 2020.
Non-Final Office Action dated Oct. 16, 2020 for U.S. Appl. No. 16/999,530, filed Aug. 21, 2010.
Office Action pertaining to Columbia Application No. NC2018/0009148 dated Aug. 21, 2020.
Office Action pertaining to Korean Application No. 9-5-2020-065058002 dated Sep. 21, 2020.
Final Rejection pertaining to U.S. Appl. No. 15/981,372 dated Jun. 9, 2021.
Korean Office Action pertaining to Application No. 10-2020-7017301 dated Apr. 15, 2021, 7 pages.
Colombia Office Action pertaining to Application No. NC2018/0009148 dated Feb. 8, 2021.
Office Action Chinese Application No. CN201780011283A dated Apr. 24, 2021, with English translation.
Office Action Saudi Application No. 518392003 dated Mar. 29, 2021, with English translation.
Office Action pertaining to European Patent Application No. 17722125.6 dated Jun. 21, 2021.
Chinese Office action pertaining to Application No. 201611044116.0 dated Aug. 12, 2021.
China Office Action pertaining to Application No. 2017800112831 dated Aug. 10, 2021.
China Office Action pertaining to Application No. 2019107714058 dated Jul. 15, 2021.
Examination Report pertaining to Colombian Application No. 20180009148 dated Jun. 21, 2021.
China Office Action pertaining to Application No. 2017800112719 dated Jul. 15, 2021.
Brazil Office Action pertaining to Application No. BR112018068810-0 dated Jul. 21, 2021.
Brazil Office Action pertaining to Application No. BR112018068818-5 dated Jul. 21, 2021.
China Office Action pertaining to CN2019107714058 dated Dec. 29, 2020.
Japan Office Action pertaining to JP2018-539146 dated Dec. 1, 2020.
Office Action pertaining to U.S. Appl. No. 15/981,372 dated Dec. 10, 2020.
Office Action pertaining to U.S. Appl. No. 16/999,530 dated Oct. 16, 2020.
Trass et al., "Coal Slurry Fuel Technology", The Canadian Journal of Chemical Engineering, vol. 65, pp. 177-201, Apr. 1987.
International Search Report and Written Opinion pertaining to PCT/GB2018/050939 dated Jul. 13, 2017.
India Office Action pertaining to Application No. 201918033361 dated Jan. 8, 2021.
China Office Action pertaining to Application No. 201780012719 dated Jan. 14, 2021.
Colombia Office Action pertaining to Application No. NC2018/0009147 dated Jan. 8, 2021.
Notice of Allowance pertaining to U.S. Appl. No. 15/981,372 dated Oct. 14, 2021.
Notice of Allowance pertaining to U.S. Appl. No. 16/999,530 dated Nov. 16, 2021.
China Rejection pertaining to Application No. 20178001271.9 dated Nov. 3, 2021.
China Rejection pertaining to Application No. 201910771405.8 dated Nov. 4, 2021.
Saudi Arabia Office Action pertaining to Application No. 518392002 dated Nov. 16, 2021.
Korean Rejection pertaining to Application No. 52018044771 dated Oct. 20, 2021.
Colombia Office Action pertaining to Application No. NC2018/0009147 dated Sep. 15, 2021.

* cited by examiner

FUEL OIL / PARTICULATE MATERIAL SLURRY COMPOSITIONS AND PROCESSES

BACKGROUND OF THE INVENTION

The invention is in the field of combination products derived from solid hydrocarbonaceous and/or solid carbonaceous material with liquid hydrocarbons, particularly the combination of coal with fuel oil, in order to create a combined product that may be used as a fuel. In particular, the invention is in the field of introduction of solid hydrocarbonaceous material, such as coal, into fuel oil in order to upgrade the solid hydrocarbonaceous material and replace a proportion of the fuel oil.

Coal fines and ultrafines, including microfines are small particles of coal generated from larger lumps of coal during the mining and preparation process. While coal fines retain the same energy potential of coal they are generally considered a waste product as the particulate nature of the product renders it difficult to market and transport. Coal fines are therefore generally discarded as spoil close to the colliery forming large waste heaps that require careful future management in order to avoid environmental contamination or even the threat to human life as demonstrated in the 1966 Aberfan disaster in South Wales, UK.

Nevertheless, coal fines do offer a cheap and plentiful supply of hydrocarbons particularly rich in carbon. It is known to add slurries of coal fines in water to fuel oils in order to upgrade the coal fine product and reduce the cost per unit volume of the blended fuel oil (see for example U.S. Pat. Nos. 5,096,461, 5,902,359 and 4,239,426). However, in its natural state, coal fines typically contain significant levels of ash-forming components that would render it unsuitable for blending directly with fuel oil. Furthermore, the amount of water present in coal fines (ca. 35% by mass or % m) is also undesirable for use in fuel oil. Selecting coal fines with low mineral matter content is one possibility for ameliorating these problems. Suitable coal fines can be manufactured by crushing and grinding seam coal with inherently low mineral matter content (e.g. <5% m), however, this limits quite substantially the types of coal that can be utilised. This approach can be expensive, and fails to address the issue of water content in the fines produced.

Water is present within seam coal in situ, held within an internal pore structure that ranges in diameter from less than two nanometres to tens of microns. The total porosity of coals varies considerably, based on the type of coal and the quantity of pore-held water. For example, water content increases from approximately 1-2% m for low-volatile and medium-volatile bituminous coals, to 3-10% m in high volatile bituminous coals, and 10-20% m in sub-bituminous coals; on to 20-50% m for brown coals (lignites). Although thermal drying can remove pore-held water, this is a temporary solution, as water is readily re-adsorbed to it natural level from the atmosphere.

Once the coal has been mined, it can be separated from extraneous mineral matter by various coal density and froth flotation techniques, which typically depend on excess water being added to the mined coal to produce a coal slurry. Furthermore, modern methods that grind minerals economically to microfine particle sizes <20 microns (20 μm), also require water to be added, resulting in a slurry. Such coal slurries typically contain 40-80% m of water, most of which is surface water attached to the outer surfaces of particles and water held loosely in the interstices between particles.

The interstitial water can be removed by mechanical filter presses, or reduced by drainage during transportation or storage, prior to utilisation.

However, surface water continues to be attached to particles. As coal particles are reduced in size the area of external surfaces increases markedly, and the quantity of surface water increases similarly. After mechanical dewatering a microfine coal sample can look and feel dry to the touch, but still contain 25% m to 50% m water. Most of this water is surface water, the remainder being pore-held.

Thus, reducing water content in coals economically to levels of the order of 2% m is a significant and challenging target for microfine coal, especially from coals with high pore-held moistures.

There has been previous research into methods of converting coal into liquid hydrocarbon products: these mainly involve solvent extraction of coal at temperatures above 400° C. under pressure in the presence of hydrogen or a hydrogen donor solvent, e.g. tetralin (1,2,3,4-tetrahydronaphthalene). This has led to several pilot scale developments and at least one full-scale operating plant using the Shenhua process at Ejin Horo Banner, Ordos, Inner Mongolia, China. Exploitation of this process involves, however, a very large capital investment and high associated running costs.

Fuel oil is a higher distillate product derived from crude oil. The term "fuel oil" covers a range of petroleum grades having a boiling point higher than that of gasoline products. Typical fuel oils are residual fuel oils (RFOs) and marine fuel oils (MFOs).

Fuel oil is classed as a fossil fuel and is a non-renewable energy source. Furthermore, while crude oil prices are quite volatile the refined products that are obtained therefrom are always relatively expensive. A way in which fuel oil could be blended with a lower cost hydrocarbon source such as coal, to extend the finite reserves of crude oil, and the resultant refined distillate products, would be highly desirable.

These and other uses, features and advantages of the invention should be apparent to those skilled in the art from the teachings provided herein.

U.S. Pat. No. 2,590,733 and DE3130662 refer to use of RFO-coal dispersions for burners/boilers designed for the use of RFO. U.S. Pat. Nos. 4,265,637, 4,251,229, 4,511,364, JPS5636589, JPS6348396, DE3130662, U.S. Pat. Nos. 5,503,646, 4,900,429 and JPS2000290673, U.S. Pat. No. 2,590,733 and DE3130662 utilise coarse particle sizes in the pulverised coal range (<200 μm) or even larger which would not be suitable for passing through fuel filters.

U.S. Pat. Nos. 4,417,901 and 4,239,426 focus on high coal loadings: 30-70% m.

U.S. Pat. Nos. 5,096,461, 5,902,359, 4,511,364 and JPS2000290673 relate specifically to coal-oil water dispersions.

U.S. Pat. Nos. 4,389,219, 4,396,397, 4,251,229, JPS54129008 and JPS5636589 include or specify stabilising additives which may move the properties of the resultant fuel oil-coal blend out of specification.

U.S. Pat. No. 4,090,853A and CA 1096620 A1, plus Clayfield, E. et al., Colloil manufacture and application (Fuel, 1981, 60, 865) relate specifically to coarser particles (<500 μm) suspended in fuel oil and water.

U.S. Pat. No. 8,177,867 B2 and Nunez, G. A. et al., Colloidal coal in water suspensions (Energy and Environmental Science, 2010 3(5), 629) relate specifically to colloidal coal-in-water slurries with 20-80% particles <1 μm size.

U.S. Pat. Nos. 4,319,980 and 4,425,135 describe respectively the manufacture and use in automotive fuels of a material prepared by amine extraction at elevated temperatures of an undefined coal. This amine extraction process splits coal into two materials with different molecular structure, i.e. coal extract chemically different from seam coal and undissolved organic material derived from coal.

U.S. Pat. No. 1,329,423 refers to the use of froth flotation to separate coal from mineral matter for particles ground to below 300 μm size. This patent does not extend the technique to particles below 20 μm in diameter.

US 2011/0239973 A1 refers to a fuel mixture comprising a suspension of a combustible solid powder in a liquid fuel, where the combustible solid is restricted to lignin or biomass nitrification products, which are not chemically quite different to coal and do not require similar preparation techniques.

The present invention addresses the problems that exist in the prior art, not least reducing reliance on fuel oil and upgrading coal fines that would otherwise be treated as a waste product, and provides environmental benefits accordingly.

SUMMARY OF THE INVENTION

Accordingly, in a first aspect the invention provides a fuel oil composition comprising:

(i) a particulate material, wherein at least about 90% by volume (% v) of the particles are no greater than about 20 μm (microns) in diameter; and (ii) a liquid fuel oil, wherein the particulate material is present in an amount of at most about 30% m (thirty percent by mass) of the total mass of the fuel oil composition; and wherein the particulate material is selected from the group consisting of: hydrocarbonaceous material and carbonaceous material.

Typically the solid hydrocarbonaceous and/or solid carbonaceous material comprises coal the coal comprises sedimentary mineral-derived solid carbonaceous material selected from hard coal, anthracite, bituminous coal, subbituminous coal, brown coal, lignite, or combinations thereof. Optionally the coal is microfine coal.

In an embodiment of the first aspect, at least 95% v of the particles forming the particulate material, optionally 98% v, suitably 99% v are no greater than about 20 μm in diameter.

In an further embodiment of the first aspect, at least 95% v of the particles forming the particulate material, optionally 98% v, suitably 99% v are no greater than about 10 μm in diameter.

According to a specific embodiment of the invention the solid hydrocarbonaceous and/or solid carbonaceous material is dewatered prior to combination with the liquid fuel oil. Typically, the particulate material has a water content of less than about 15% m, 5% m or 2% m. The total water content of the fuel composition is typically less than 5% m, or 2% m.

In another embodiment of the invention, the solid hydrocarbonaceous and/or solid carbonaceous material is subjected to at least one de-ashing step or de-mineralising step prior to combination with the liquid fuel oil.

In an alternative embodiment of the invention, the solid hydrocarbonaceous and/or solid carbonaceous material comprises a dewatered ultrafine coal preparation that comprises a low inherent ash content.

Suitably the ash content of the particulate material is less than about 20% m of the coal preparation; optionally less than about 15% m, suitably less than about 10% m, or less than about 5% m, or less than about 2% m, or less than 1% m.

According to a specific embodiment of the invention, the liquid fuel oil is selected from one of the group consisting of: marine diesel, diesel and kerosene for stationary applications, marine bunker oil; residual fuel oil; and heavy fuel oil. Suitably the liquid fuel oil conforms to, or is defined by, the main specification parameter included in one or more of the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards. Alternatively, the liquid fuel oil conforms to the main specification parameters included in one or more of the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards. Suitably the liquid fuel oil conforms to the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards.

In embodiments of the invention, the term "main specification parameter" refers to a parameter selected from the group consisting of: viscosity at 100° C.; viscosity at 50° C.; viscosity at 40° C.; density at 15° C.; ash content; sulphur content; water content; flash point; and pour point.

In embodiments of the invention, the term "main specification parameters" refers to two or more parameters, suitably, 2, 3, 4, 5, 6, 7, 8, 9 or 10 parameters, selected from the group consisting of: viscosity at 100° C.; viscosity at 80° C.; viscosity at 50° C.; viscosity at 40° C.; density at 15° C.; ash content; sulphur content; water content; flash point; and pour point.

In an embodiment of the invention the fuel oil composition comprising both solid hydrocarbonaceous and/or solid carbonaceous material and liquid fuel oil conforms to the main specification parameter included in one or more of the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards. Alternatively, the fuel oil composition comprising both solid hydrocarbonaceous and/or solid carbonaceous material and liquid fuel oil conforms to the main specification parameters included in one or more of the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards. Suitably, the fuel oil composition comprising both solid hydrocarbonaceous and/or solid carbonaceous material and liquid fuel oil conforms the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards.

According to a specific embodiment of the invention, the solid hydrocarbonaceous and/or solid carbonaceous material is present in an amount of at most about 20% m, suitably about 15% m, optionally about 10% m of the total mass of the fuel oil composition.

In one embodiment of the invention, the solid hydrocarbonaceous and/or solid carbonaceous material is present in an amount of at least about 0.01% m, suitably at least about 0.10% m, optionally about 1% m of the total mass of the fuel oil composition.

In a particular embodiment of the invention, the fuel oil composition comprises the solid hydrocarbonaceous and/or solid carbonaceous material in the form of a suspension. Typically the suspension is stable for at least 1 hour, optionally at least 24 hours, suitably at least 72 hours. In one embodiment of the invention the suspension is stable for more than 72 hours. In an embodiment of the invention, the fuel composition comprises a dispersant additive.

A second aspect of the invention provides a process for the preparation of a fuel oil composition comprising combining a solid hydrocarbonaceous and/or solid carbonaceous material, wherein the material is in particulate form, and wherein at least about 90% v of the particles are no greater than about 20 μm in diameter; and a liquid fuel oil, wherein the solid hydrocarbonaceous and/or solid carbonaceous material is present in an amount of at most about 30% m (30% by mass) of the total mass of the fuel oil composition.

In an embodiment of the second aspect, at least 95% v of the particles forming the particulate material, optionally 98% v, suitably 99% v are no greater than about 20 μm in diameter.

In an further embodiment of the second aspect, at least 95% v of the particles forming the particulate material, optionally 98% v, suitably 99% v are no greater than about 10 μm in diameter.

In an embodiment of the second aspect of the invention, the solid hydrocarbonaceous and/or solid carbonaceous material is dispersed in the liquid fuel oil. Suitably, the dispersion is achieved by a method selected from the group consisting of: high shear mixing; ultrasonic mixing, or a combination thereof.

In an embodiment of the second aspect of the invention, the solid hydrocarbonaceous and/or solid carbonaceous material comprises coal.

In some embodiments of the second aspect of the invention, the solid hydrocarbonaceous and/or solid carbonaceous material is de-watered prior to combination with the liquid fuel oil. Optionally, the solid hydrocarbonaceous and/or solid carbonaceous material is subject to a de-mineralising/de-ashing step prior to combination with the liquid fuel oil. Suitably, the de-ashing or de-mineralisation is via froth flotation techniques.

In some embodiments of the process of the present invention, the solid hydrocarbonaceous and/or solid carbonaceous material is subjected to a particle size reduction step prior to combination with the liquid fuel oil. Particle size reduction may be achieved by any appropriate method. Suitably, the particle size reduction is achieved by a method selected from the group consisting of: milling, grinding, crushing, high shear grinding or a combination thereof.

In an embodiment of the invention, the liquid fuel oil is selected from one of the group consisting of: marine diesel, diesel and kerosene for stationary applications, marine bunker oil; residual fuel oil; and heavy fuel oil. Alternatively, or in addition, the liquid fuel oil conforms to, or is defined by, the main specification parameter included in one or more of the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards. Alternatively, the liquid fuel oil conforms to the main specification parameters included in one or more of the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards. Suitably, the liquid fuel oil conforms to the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards A third aspect of the invention comprises a method for changing the grade of a liquid fuel oil comprising adding to the fuel oil a solid hydrocarbonaceous and/or solid carbonaceous material, wherein the material is in particulate form, and wherein at least about 90% v of the particles are no greater than about 20 μm in diameter.

In an embodiment of the third aspect, at least 95% v of the particles forming the particulate material, optionally 98% v, suitably 99% v are no greater than about 20 μm in diameter.

In an further embodiment of the third aspect, at least 95% v of the particles forming the particulate material, optionally 98% v, suitably 99% v are no greater than about 10 μm in diameter.

Suitably the grade of the liquid fuel oil is defined by the main specification parameter included in one or more of the fuel oil standards selected from the group consisting of: ISO 8217:2010; ISO 8217:2012; ASTM D975-14; ASTM D396; BS 2869:2010; GOST10585-99, GOST10585-75 and equivalent Chinese standards. Alternatively, the liquid fuel oil is defined by the main specification parameters included in one or more of the fuel oil standards selected from the group consisting of: ISO 8217:2010; ISO 8217:2012; ASTM D975-14; ASTM D396; BS 2869:2010; GOST10585-99, GOST10585-75 and equivalent Chinese standards. Suitably, the liquid fuel oil is defined by the fuel oil standards selected from the group consisting of: ISO 8217:2010; ISO 8217:2012; ASTM D396; ASTM D975-14, BS 2869:2010, GOST10585-99, GOST10585-75 and equivalent Chinese standards.

A fourth aspect of the invention comprises a method of adjusting the flash point of a liquid fuel oil, wherein the method comprises combining a liquid fuel oil with particulate material, wherein the fuel oil is selected from the group consisting of: marine diesel; diesel for stationary applications, kerosene for stationary applications, marine bunker oil; residual fuel oil; and heavy fuel oil. Suitably, the particulate material comprises coal.

In an embodiment of the fourth aspect, at least 95% v of the particles forming the particulate material, optionally 98% v, suitably 99% v are no greater than about 20 μm in diameter.

In an further embodiment of the fourth aspect, at least 95% v of the particles forming the particulate material, optionally 98% v, suitably 99% v are no greater than about 10 μm in diameter.

It will be appreciated that the features of the invention may be subjected to further combinations not explicitly recited above.

BRIEF DESCRIPTION OF THE DRAWINGS

The invention is further illustrated by reference to the accompanying drawings in which.

DETAILED DESCRIPTION OF THE INVENTION

Figure 1:
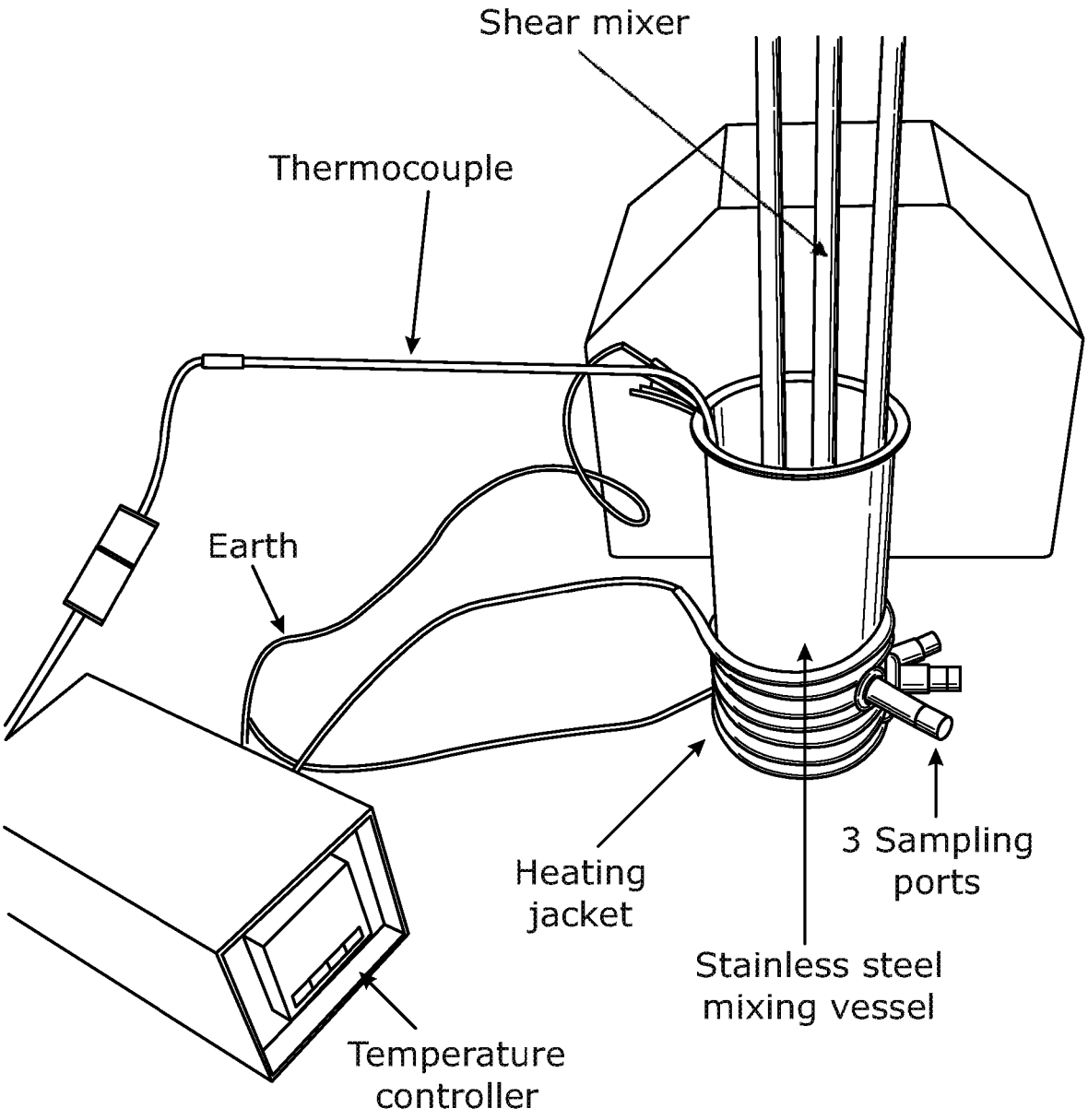
FIG. 1 shows a rig used to measure microfine coal dispersion in RFO.

All references cited herein are incorporated by reference in their entirety. Unless otherwise defined, all technical and scientific terms used herein have the same meaning as commonly understood by one of ordinary skill in the art to which this invention belongs.

The invention relates, in a specific embodiment, to preparing and blending de-ashed or demineralised, de-watered/dehydrated coal powder, commonly termed in the industry "fines", suitably selected from "microfines" (typical particle size<20 μm), with fuel oil to produce a combined blended product. The inventive concept further extends to the uses of the blended fuel oil product, including preparing fuels based on blended fuel oil products.

Prior to further setting forth the invention, a number of definitions are provided that will assist in the understanding of the invention.

As used herein, the term "comprising" means any of the recited elements are necessarily included and other elements may optionally be included as well. "Consisting essentially of" means any recited elements are necessarily included, elements that would materially affect the basic and novel characteristics of the listed elements are excluded, and other elements may optionally be included. "Consisting of" means that all elements other than those listed are excluded. Embodiments defined by each of these terms are within the scope of this invention.

The term "coal" is used herein to denote readily combustible sedimentary mineral-derived solid carbonaceous material including, but not limited to, hard coal, such as anthracite; bituminous coal; sub-bituminous coal; and brown coal including lignite (as defined in ISO 11760:2005 and in equivalent Chinese standards). The term "coal" does not extend to extracts, or products derived from coal, where the chemical composition of the hydrocarbonaceous content of the material has been altered.

The definition of a fuel oil varies geographically. As used herein, fuel oils may relate to:

- Residue-containing burner fuels, middle distillate fuels for stationary applications and kerosene-type burner fuels, as defined in BS 2869:2010+A1:2011, Fuel oils for agricultural, domestic and industrial engines and boilers—Specification, and in equivalent Chinese standards;
- Fuel oil grades intended for use in various types of fuel-oil-burning equipment under various climatic and operating conditions as specified in ASTM D396-15c, Standard Specification for Fuel Oils, in GOST standards 10585-99 and 10585-75, and in equivalent Chinese standards;
- Diesel Fuel Oil Grade No. 4-D for use in low- and medium-speed diesel engines in applications necessitating sustained loads at substantially constant speed as defined in ASTM D975-14, Standard Specification for Diesel Fuel Oils, and in equivalent Chinese standards; and
- Marine residual fuel oils (RFO) and marine distillate fuels as specified in ISO 8216-1:2010 Petroleum products. Fuels (class F) classification. Part 1: Categories of marine fuels and ISO 8217:2012 Petroleum products. Fuels (class F). Specifications of marine fuels, and in equivalent Chinese standards.

Equivalent grades to the above fuel oils as specified may be used in other countries worldwide.

As used herein, the term "ash" refers to the inorganic—e.g. non-hydrocarbon—component found within most types of fossil fuel, especially that found in coal. Ash is comprised within the solid residue that remains following combustion of coal, sometimes referred to as fly ash. As the source and type of coal is highly variable, so is the composition and chemistry of the ash. However, typical ash content includes several oxides, such as silicon dioxide, calcium oxide, iron (III) oxide and aluminium oxide. Depending on its source, coal may further include in trace amounts one or more substances that may be comprised within the subsequent ash, such as arsenic, beryllium, boron, cadmium, chromium, cobalt, lead, manganese, mercury, molybdenum, selenium, strontium, thallium, and vanadium.

As used herein the term "de-ashed coal" refers to coal that has a proportion of ash-forming components that is lower than that of its natural state. The related term "demineralised coal" is used herein to refer to coal that has a reduced proportion of inorganic minerals compared to its natural state. The terms "de-ashed coal" and "demineralised coal" may also be used to refer to coal that has a low naturally-occurring proportion of ash-forming components, or minerals respectively, as may the terms "low ash coal" or "low mineral content coal".

As used herein, the term "coal fines" refers to coal in particulate form with a maximum particle size typically less than 1.0 mm. The term "coal ultrafines" or "ultrafine coal" or "ultrafines" refers to coal with a maximum particle size typically less than 0.5 mm. The term "coal microfines" or "microfine coal" or "microfines" refers to coal with a maximum particle size typically less than 20 μm.

The term "pulverised coal" as used herein refers to a coal that has been crushed to a fine dust. The particle size is generally large in the order of 200 μm with wide distribution that lacks uniformity.

The term "hydrocarbonaceous material" as used herein refers to fossilised organic matter containing hydrocarbons; hydrocarbons being an organic compound consisting substantially of the elements hydrogen and carbon.

The term "carbonaceous material" as used herein refers to materials containing predominantly carbon including coke, activated carbon and carbon black. Carbonaceous material may be derived by pyrolysis of organic matter.

The term "carbon black" as used herein refers to finely divided forms of substantially pure elemental carbon prepared by the incomplete combustion or thermal decomposition of gaseous or liquid hydrocarbons, especially petroleum products.

The term "activated carbon" as used herein refers to very porous carbon processed from materials like nutshells, wood, and coal by various combinations of pyrolysis and activation steps. Activation involves high temperature treatment of pyrolysed materials in the absence of air, either with steam, carbon dioxide, or oxygen, or following impregnation by certain specific acids, bases or salts.

The term "dispersant additive" as used herein refers to a substance added to a mixture to promote dispersion or to maintain dispersed particles in suspension.

As used herein, the term "water content" refers to the total amount of water within a sample, and is expressed as a concentration or as a mass percentage. When the term refers to the water content in a coal sample, it includes the inherent or residual water content of the coal, and any water or moisture that has been absorbed from the environment. When the term refers to the water content in the fuel composition, it includes the total water content of the composition introduced from all components, including the liquid fuel oil, the particulate material and any additives or other components.

As used herein the term "dewatered particulate material" refers to particulate material that has a proportion of water that is lower than that of its natural state. The term "dewatered particulate material" may also be used to refer to particulate material that has a low naturally-occurring proportion of water. The term "dewatered coal" has a corresponding meaning for when the particulate material is coal. In embodiments of the present invention the amount of water as a proportion of the total mass of the particulate material is substantially low enough that the material, when combined with a liquid fuel oil, remains capable of falling within the main specification parameters of that fuel oil.

Fuel oil is expensive and is a non-renewable source of energy. Coal-fines are generally regarded as a waste product and are available cheaply in plentiful supply. The problem addressed by the present invention is to provide a blended fuel oil that is cheaper than current alternatives, yet still meet required product and emission criteria to enable its use as a direct replacement in burners and boilers designed for fuel oil with minimal or no adaptation. Non-automotive use of fuel oil includes boilers and engines both for marine use and stationary applications, such as power stations and industrial, commercial and residential use. These fuels are now tightly specified to protect more sophisticated burner and boiler equipment controls are also needed to limit boiler emissions. Different specifications apply for the range of technologies and these may vary according to the region or country of use. The main parameters from some of some widely used specifications are shown below in Tables 1a, 1b and 1 c. This includes details for international trading specifications for Heavy Fuel Oil used in China (S&P Global Platts Methodology and Specifications Guide: China Fuel Oil).

Mineral matter content is controlled in most fuel oil grades by specifying the ash content. The limits for ash content for these fuel oil grades vary from 0.01% m (marine distillate fuel oil) to 0.15% m (Marine RFO grade RMK and ASTM D396 Heavy fuel oil No. 5). The proportion of a microfine coal (e.g. one with 1% m ash content) that can be added to fuel oil and remain within specifications can vary considerably therefore from <1% m in marine distillate fuel oil (also known as marine diesel) to <15% m in ASTM D396 HFO No. 5, and is unconstrained in ASTM D396 HFO No. 6. For the purposes of these calculations, the ash content of the fuel oil is assumed to be close to zero. It is therefore important to demineralise (or de-ash) the microfine coal as effectively as possible.

In view of the above, there exists a technical prejudice in the mind of the skilled person against using coal in fuel oils due to the perceived abundance of mineral matter (or ash-forming components) in most coals.

TABLE 1a

Typical limits for the main specification parameters of various fuel oil grades
MARINE FUEL OIL GRADES

| ISO 8217:2010 Marine or Bunker RFO grades | | | | | | | | | | | | | |
|---|---|---|---|---|---|---|---|---|---|---|---|---|---|
| | | | RMA | RMB | RMD | RME | RMG | | | | RMK | | |
| | | | 10 | 30 | 80 | 180 | 180 | 380 | 500 | 700 | 380 | 500 | 700 |
| Viscosity @ 50° C. | $mm^2/s$ | max | 10 | 30 | 80 | 180 | 180 | 380 | 500 | 700 | 380 | 500 | 700 |
| Density @ 15° C. | $kg/m^3$ | max | 920 | 960 | 975 | 991 | 991 | | | | 1010 | | |
| Ash content | % m | max | 0.04 | | 0.07 | | 0.1 | | | | 0.15 | | |
| Sulphur content | % m | max | Emission Control Areas < 0.1%, Globally: In transition from 3.5% to 0.5% by 2020 subject to 2018 review | | | | | | | | | | |
| Water | % m | max | 0.3 | | | | 0.5 | | | | | | |
| Flash Point | ° C. | min | 60 | | | | | | | | | | |

| ISO 8217:2010 Marine or Bunker distillate fuel oil grades | | | | | | |
|---|---|---|---|---|---|---|
| | | | DMX | DMA | DMZ | DMB |
| Viscosity @ 40° C. | $mm^2/s$ | max | 5,500 | 6,000 | | 11,000 |
| | | min | 1,400 | 2,000 | 3,000 | 2,000 |
| Density @ 15° C. | $kg/m^3$ | max | — | 890 | 890 | 900 |
| Ash content | % m | max | 0.01 | | | |
| Sulphur content | % m | max | 1.0 | 1.5 | | 2.0 |
| Water | % m | max | | — | | 0.3 |
| Flash Point | ° C. | min | 43 | | 60 | |

TABLE 1b

Typical limits for the main specification parameters of stationary combustion fuel oil grades
STATIONARY COMBUSTION FUEL OIL GRADES

| | | | BS 2869 | | | | | | | ASTM 396 Heavy Fuel Oil grades | | | | |
|---|---|---|---|---|---|---|---|---|---|---|---|---|---|---|
| | | | Kerosene grades | | Diesel | RFO burner grades | | | | | | | | |
| | | | Class | | | | | | | No. 4 | | No. 5 | No. 5 | |
| | | | C1 | C2 | D | E | F | G | H | Light | No. 4 | Light | Heavy | No. 6 |
| Viscosity @ 40° C. | $mm^2/s$ | min | | 1.0 | 1.5 | | — | | | 1.9 | >5.5 | | — | |
| | | max | | 2.0 | 5.0 | | — | | | 5.5 | 24 | | — | |
| Viscosity @ 100° C. | $mm^2/s$ | min | | | | — | 8.201 | 20.01 | 40.01 | | | 5.0 | 9.0 | 15.0 |
| | | max | | | | 8.20 | 20.00 | 40.00 | 56.00 | | | 8.9 | 14.9 | 50.0 |
| Density @ 15° C. | $kg/m^3$ | min | | 750 | 820 | | | | | 878 | | | — | |
| | | max | | 840 | | | | | | | | — | | |
| Ash content | % m | max | | | 0.01 | | 0.10 | | 0.15 | 0.05 | 0.10 | 0.15 | 0.15 | — |
| Sulphur content | % m | max | 0.04 | 0.1 | 0.1 | | 1.0 | | | | | — | | |
| Water | % m | max | | | 0.02 | 0.5 | 0.75 | | 1.0 | | | | | |
| Water & sediment | % m | max | | | | | — | | | | 0.5 | | 1.0 | 2.0 |
| Flash Point | ° C. | min | 43 | 38 | 56 | | 66 | | | 38 | | 55 | | 60 |

TABLE 1c

Typical limits for the main specification parameters of various fuel oil grades
International Trading Specifications for Heavy Fuel Oil used in China

| | | | Domestic Grades | | Imported Grades | | | Mazut M-100 GOST |
|---|---|---|---|---|---|---|---|---|
| | | | Cracked | | Straight-run | | Cracked | 10585-99[1] |
| Sulphur content | % m | max | 1.5 | 2.5 | 1.5 | 2.5 | 3.5 | [2] |
| Viscosity @ 50° C. | $mm^2/s$ | max | | | 180 | | | n.a. |
| Viscosity @ 80° C. | | max | | | | | | 118 |
| Viscosity @ 100° C. | | max | | | | | | 50 |
| Density @ 15° C. | $kg/m^3$ | max | 980 | 985 | | | 980 | *890-920* |
| Ash content | % m | max | | | 0.10 | | | [3] |
| Sediment | % m | max | | | 0.10 | | | 1.0 |
| Water | % m | max | 1.0 | 0.5 | 2.0 | 1.0 | 0.5 | 1.0 |
| Pour Point | ° C. | max | 24 | 20 | | | 24 | 25[4] |
| Flash Point | ° C. | min | 60 | | | 66 | | 65 |

[1]GOST standard 10585-75 is also still used in trading. This contains some added specification parameters shown in italics.
[2]7 grades are specified based on sulphur content:
I: <0.5% m, II: <1.0% m, III: <1.5% m, IV: <2.0% m, V: <2.5% m, VI: <3.0% m, VII: <3.5% m.
[3]2 grades: low-ash: <0.05% m, more ash: <0.14% m
[4]Referred to as temperature of solidification The limits for water content vary from 0.3% m (e.g. Marine RFO grade RMA) to 1% m (UK BS 2869 RFO burner fuel grades G and H). ASTM D396 specifies water plus sediment and the most viscous HFO grade No. 6 has a limit of 2% m for water plus sediment. The proportion of a microfine coal (e.g. one with 2% m water content) that can be added to fuel oil and remain within specifications can vary considerably therefore from <15% m in Marine RFO grade RMA to <50% m in UK BS 2869 RFO burner fuel grades G and H. It is therefore important to dewater the coal as effectively as possible. Table 2 illustrates the range of maximum limits allowable in various non-automotive fuels by ASTM specifications, and how low they must be. These are long-standing limits which have been required since the 1980s or earlier.

TABLE 2

Maximum limits of water allowed in various fuels by ASTM specifications

| ASTM No. | Standard Specification | Maximum water content (or water + sediment) allowed |
|---|---|---|
| D396-16 | For Fuel Oils | Water + sediment limits: 0.05% m No. 1, No. 2 and B6-B20 grades (distillate grades). 0.5% m for No. 4 grade. 1.00% m for No. 5 grade. 2.00% m for No. 6 grade (Nos. 4-6 are Residual Fuel Oils). |
| D975-16a | For Diesel Fuel Oils | Water + Sediment 0.05% m limit in Nos. 1-D & 2D, but 0.5% m in 4D for low and medium speed engines, section X8.2 is a guideline on water control and removal. |
| D3699-13BE01 | For Kerosine | No quantitative water limit, but "shall be essentially free of water" |

TABLE 2-continued

| Maximum limits of water allowed in various fuels by ASTM specifications | | |
|---|---|---|
| ASTM No. | Standard Specification | Maximum water content (or water + sediment) allowed |
| D7467-15ce1 | For Diesel Fuel Oil, BioDiesel Blend (B6 to B20) | Water + Sediment 0.05% m limit, as Diesel Fuel Oil, section X4 is a guideline on water control and removal. |
| D6751-15ce1 | For BioDiesel Fuel Blend Stock (B100) for Middle Distillate Fuels | Water content <0.05% v |

In view of the above, the skilled person would be dissuaded from considering inclusion of particulate material, in particular coal, in fuel oils due to the need to keep water content low (for example, <2% m), amongst other considerations.

The proportion of a microfine coal (e.g. one with 0.5% m sulphur content) that can be added to fuel oil is only constrained by those fuel oil specifications with sulphur content limits of below 0.5% m.

Most fuel oil specifications allow sulphur content at 1% m or higher; in these cases microfine coal addition is a benefit and will reduce fuel sulphur content and the associated sulphur oxides emitted from combustion devices using fuel oil containing microfine coal. Until recently, for the fuel oil specifications shown below, the level of microfine coal addition was only limited by sulphur content in Marine RFO supplied in Emission Control Areas, and in this case to <20% m.

However, on 27 Oct. 2016, the International Maritime Organisation voted to adopt a 0.50% m maximum sulphur global limit for ship bunker fuels from 2020. As such, the sulphur level in the global market for marine fuel will reduce from 3.50% m to 0.50% m. Meeting these new requirements will have a massive impact on refinery configuration and operations, and hence cost. There is also an alternative which permits the use of abatement measures on ships (e.g. exhaust flue gas scrubbing), or sulphur trading schemes, to give an equivalent environmental performance to burning lower sulphur fuels.

Upgrading coal fines by blending with fuel oil is known when the coal fines are in their natural state. However, in their natural state, coal fines typically contain levels of ash-forming components and sulphur that would render them unsuitable for blending with fuel oils which must meet set current fuel oil specifications and emissions limits to operate efficiently in burners and boilers designed for fuel oil. Furthermore, the amount of water present in coal fines (ca. 35% m) is also undesirable for use in fuel oils.

To date, it has not been possible to produce economically a coal-fuel oil blend which can meet fuel oil specifications requiring very low mineral matter content and particle sizes predominantly <10 μm (preferably mainly <2 μm) i.e. much smaller than the 500 micron upper limit associated with "ultrafine" coal.

Hitherto published information regarding dispersion of coal fines in fuel oil has not addressed fitness for use in fuel oil boilers, but has been concerned with reducing spontaneous combustion risks, especially for lignite, simplifying transportation via improved pumpability, and improving combustion in coal-fired boilers, often via the use of fuel-water emulsions containing coal and fuel oil.

Particulate material, in particular, coal fines or microfine coal fines for use in the present invention typically have a low water content (suitably <15% m, <10% m, <5% m, <3% m, <2% m, <1% m, <0.5% m, of the total mass of the fuel composition) and a low ash content (suitably <10% m, <5% m, <2% m, <1% m, <0.5% m, of the total mass of the fuel composition).

Demineralising (or de-ashing) and dewatering of particulate material, in particular coal fines, is typically achieved via a combination of froth flotation separation, specifically designed for ultrafines and microfine particles, plus mechanical and thermal dewatering techniques known in the art. De-watered particulate material or coal fines may also be provided as a cake comprising particles in a hydrocarbon solvent, water having been removed through the use of one or more hydrophilic solvents. Reduction of mineral ash content in coal fines is described, for example, in U.S. Pat. No. 4,537,599, US 20110174696 A1, US2016/082446 and Osborne D. et al., Two decades of Jameson Cell installations in coal, (17th International Coal Preparation Congress, Istanbul, 1-6 Oct. 2013).

Alternatively, certain coal seams produce coal that have a suitable ash, and potentially water content. Suitable treatment of this coal to produce coal fines of the required particle size would also be suitable for the invention.

It has surprisingly been found that dewatered, demineralised (or de-ashed) coal microfines product is particularly suitable for providing a blended fuel oil which can still meet the required specifications for use in stationary and marine boilers designed for fuel oil, by having an acceptable level of water, mineral matter, sulphur and particle size.

The present invention blends (i.e. suspends or disperses) the solid particulate matter, suitably demineralised (or de-ashed), de-watered/dehydrated microfine coal, in fuel oil. This not only upgrades the particulate material product and reduces the overall cost of the heavy fuel oil, but also maintains desirable emission characteristics (i.e. low ash, low sulphur emissions) and satisfactory boiler operability. The amount of particulate material, suitably microfine coal that may be blended with the fuel oil is typically determined by the content of ash-forming components, water and sulphur. The concept has been demonstrated with blends of 10% m coal microfines in residual fuel oils. The amount of blended particulate material may be well in excess of 10% m of the blend, for example up to 30% m, 40% m, 50% m, 60% m or more.

Due to the fine particulate nature of the particulate material, suitably microfine coal, it has been found that there is no significant settling of the solids on long-term storage, more than several months, at ambient temperatures. The particles may also pass through filters employed in systems that utilise fuel oils such as residual fuel oils, marine diesel, diesel heating fuel and kerosene heating fuel.

Any particle size of the particulate material, suitably coal fines, that is suitable for blending with fuel oil is considered to be encompassed by the invention. Suitably, the particle size of the particulate material is in the ultrafine range. Most suitably the particle size of the particulate material is in the microfine range. Specifically, the maximum average particle size may be at most about 50 μm. More suitably, the maximum average particle size may be at most around 40 μm, 30 μm, 20 μm, 10 μm, or 5 μm. The minimum average particle size may be 0.01 μm, 0.1 μm, 0.5 μm, 1 μm, 2 μm, or 5 μm.

An alternative measure of particle size is to quote a maximum particle size and a percentage value or "d" value for the proportion by volume of the sample that falls below that particle size. For the present invention any particle size of particulate material, suitably coal fines, that is suitable for blending with fuel oil is considered to be encompassed by the invention. Suitably, the particle size of the blending with fuel oil is in the ultrafine range. Most suitably the particle size of the particulate material is in the microfine range. Specifically, the maximum particle size may be at most around 50 μm. More suitably, the maximum particle size may be at most about 40 μm, 30 μm, 20 μm, 10 μm, or 5 μm. The minimum particle size may be 0.01 μm, 0.1 μm, 0.5 μm, 1 μm, 2 μm, or 5 μm. Any "d" value may be associated with these particle sizes. Suitably, the "d" value associated with any of the above maximum particle sizes may be d99, d98, d95, d90, d80, d70, d60, or d50.

Preparing dewatered, low ash coal particles having an average particle size of <5 μm ready for dispersion into fuels, requires the combination of froth flotation, crushing, grinding and blending steps. The procedure may differ depending on whether the source is a coal fines deposit or a production coal. For coal fines deposits, coarse grinding may precede froth flotation that, in turn, is followed by wet fine grinding of coal to sizes significantly below industry norms, prior to the dewatering steps. For low ash production wet coal, crushing and coarse grinding also need to be followed by wet grinding techniques not commonly used for coal, with final dewatering. For low-ash coal with a low, in situ moisture content, crushing and grinding can be carried out dry, followed by minimal or no water removal.

This technology upgrades the coal fines product. The overall cost of the fuel oil is reduced as is the amount of fuel oil per unit of the blended fuel composition.

The amount of particulate material, suitably coal or microfine coal, that may be blended with the fuel oil is at least 0.1 wt %, suitably at least 1 wt %, 5 wt %, typically around 10 wt % or 20 wt %, at most 70 wt %, suitably at most 60 wt %, optionally at most 50 wt %, 40 wt %, 30 wt %.

The invention is further illustrated by the following non-limiting examples.

EXAMPLES

Example 1a—Demineralising and Dewatering of Coal Fines May be Achieved Via a Combination of Froth Flotation Separation, Specifically Designed for Ultrafines and Microfine Particles, Plus Mechanical and Thermal Dewatering Techniques The coal slurry is screened, collected in a tank and froth flotation agents are added using controlled dose rates. Micro particle separators filled with process water and filtered air from an enclosed air compressor are used to sort hydrophobic carbon materials from hydrophilic mineral materials. Froth containing carbon particles overflows the tank and this froth is collected in an open, top gutter. The mineral pulp is retained in the separation tank until discharged, whereas the demineralised coal slurry is de-aerated, before being pumped to the pelletisation step. Further coal particle size reduction may be achieved, if necessary, by various known milling techniques, including ones where a hydrocarbon oil is used as a milling aid.

Mechanical dewatering of the demineralised microfine coal slurry is carried out via a rotary vacuum drum filter or filter press. The resultant microfine coal wet-cake may be dried thermally or mechanically to a powder form or pelletized before drying. For pelletisation, a specific modifier is added to the filter cake in a mixer to optimize pelletisation and the modified cake is transported to an extruder where it is compressed into pellets. The demineralised coal pellets are then dried thermally by conveying them via an enclosed conveyor belt and a bucket elevator into a vertical pellet dryer where oxygen-deprived hot process air is blown directly through the microfine coal pellets.

In this way microfine coals 1, 3, 4b, 5, 7 and 8 have been prepared, see Table 3. Their particle size decreases in the order:— coal 3 (d90=14.2 μm)>coal 1 (d90=12.0 μm)>coal 4b (d90=8.0 μm)>coal 7 (d90=6.7 μm)>coal 5 (d90=5.1 μm)>coal 8 (d90=4.3 μm).

Coals D, F, 5, 6 and 8 are examples of coals with very low ash contents of 1.4% m, 1.5% m, 1.5% m, 1.8% m and 1.6% m respectively. Coal 7 has an exceptionally low ash content of just 0.8% m. Fuel oil ash content specifications vary from 0.01% m (marine distillate fuel oil) to 015% m (marine RFO grade RMK). Assuming the fuel oil ash content is close to zero, then the proportions of microfine coals D, F, 5, 6, 7 and 8 that can be added to RMK and remain within specifications are 10.7% m, 10.0% m, 10.0% m, 8.3% m 18.8% m and 9.4% m, respectively. Another froth flotation fraction, coal 7A, prepared alongside coal 7 had an even lower ash content of 0.5% m. Similarly, not only could coal 7A be added to RMK at a concentration up to 30% m, but coal 7A could be added to marine distillate fuel oil at a concentration up to 2% m.

These preparation techniques also result in producing microfine coal with a low sulphur content; coals 3 and 8, Table 3, are examples of coals with low sulphur contents of 1.0% m and 0.9% m respectively which can readily be used in most RFO grades with a sulphur limit of 3.5% m. The sulphur content of coal 7 of just 0.4% m is exceptionally low and would be compatible with future (post 2020) marine RFO grades requiring the lower sulphur limit of 0.5% m. Because of the large investment by refineries anticipated to meet such a low RFO sulphur specification, there is here a clear commercial opportunity for microfine coal.

Example 1b—Obtaining Coal Microfines by Grinding Larger Lumps and Particles of Coal in Wet Media The type of coal may be selected based on favourable properties of the coal such as low ash or water content or ease of grindability (e.g. high Hardgrove Grindability Index). Coal microfines were obtained by a variety of standard crushing and grinding size reduction techniques in wet media followed by dewatering 1. Crushing to reduce production washed, wet coal (e.g. coal D or coal F, Table 3) from 50 mm or thereabouts to approximately 6 mm, e.g. via a high pressure grinding roller mill or jaw crusher: suitable equipment is manufactured by Metso Corporation, Fabianinkatu 9 A, PO Box 1220, FI-00130 Helsinki, FIN-00101, Finland or McLanahan Corporation, 200 Wall Street Hollidaysburg, Pa. 16648, USA.
2. Produce a wet <6 mm slurry and reduce to 40 μm with a suitable ball mill, rod mill or stirred media detritor: suitable equipment is manufactured by Metso Corporation. Optionally this can be followed by high-shear grinding of coal by a high-shear mixer. Suitable shear mixers are manufactured by Charles Ross & Son Co., 710 Old Willets Path, Hauppauge, N.Y. 11788, USA or Silverson Machines, Inc., 355 Chestnut St., East Longmeadow, Mass. 01028, USA.
3. Reduce the <40 μm slurry to <1 μm or thereabouts using a nanomill, either a peg mill or horizontal disc mill: suitable equipment is manufactured by NETZSCH-Feinmahltechnik GMBH, Sedanstraße 70, 95100 Selb, Germany. Isamills can also be used to reduce particle size to <5 μm or lower by attrition and abrasion: these mills are widely available, but no longer in production.

4. Dewater from approximately 50% m to <20% m or thereabouts, with a tube press operating at high pressures through a membrane or a vertical plate pressure filter: suitable equipment is manufactured by Metso Corporation. Alternative dewatering methods include vibration assisted vacuum dewatering (described in US2015/0184099), and filter presses, e.g. as manufactured by McLanahan Corporation.
5. Dewatering to <2% m by
   a. thermal drying, such as fluidised bed, rotary, flash or belt dryers: suitable equipment is manufactured by companies, such as ARVOS Group, Raymond Bartlett Snow Division. 4525 Weaver Pky. Warrenville, Ill. 60555, USA and Swiss Combi Technology GmbH, Taubenlochweg 1, 5606 Dintikon, Switzerland.
   b. solvent-dewatering techniques with alcohols, ethers or ketones as described for example in U.S. Pat. Nos. 3,327,402, 4,459,762 and 7,537,700.

Example 1c—Obtaining Coal Microfines by Grinding Larger Lumps and Particles of Coal in a Dry State Coal microfines were obtained by standard crushing, grinding and pulverising size reduction techniques in a dry state.

1. Crushing of dry, raw seam coal with a jaw crusher to <30 mm size.
2. Pulverising dried coal from <30 mm to <45 μm size or thereabouts using ball mills with classifiers or by using centrifugal attrition mill (e.g. Lopulco mill, which is widely available, if no longer manufactured): suitable equipment is manufactured by Loesche GmbH, Hansaallee 243, 40549 Dusseldorf, Germany and British Rema Process Equipment Ltd, Foxwood Close, Chesterfield, S41 9RN, U.K.
3. Reduction to <1 μm or thereabouts with an air microniser (or jet mill): suitable equipment is manufactured by British Rema.

In this way several different size fractions (coals 2A-2E) have been prepared from coal D which has a very low ash content of 1.4% m, see Tables 3 and 5. Their particle size decreases in the order:— coal 2E (d90=86 μm)>coal 2D (d90=21.1 μm)>coal 2C (d90=15.1 μm)>coal 2B (d90=6.7 μm)>coal 2A (d90=4.4 μm).

Assuming the fuel oil ash content is close to zero, then the proportions of microfine coal D that can be added to RMK and remain within specifications is 10.7% m. Coal D is another example of a coal with a very low sulphur content of 0.6% m which could readily be used in most RFO grades.

Example 1d—Obtaining Microfine Coal-Fuel Oil Cake by Grinding Dry Coal with a Fuel Oil or Similar Oil Product A cake of microfine coal in fuel oil was obtained by grinding dry coal (e.g. coal D, Table 3) in a Netzsch LME4 Horizontal media mill or Laboratory Agitator Bead Mill "LabStar" apparatus with fuel oil as the fluid medium at a 40-50% m solids concentration in the slurry.

In this way different size samples of microfine coal D have been prepared with d90 values as low as 10.7 μm and 2.2 μm respectively.

The resultant blends of diesel and coal D were well-dispersed when the grinding was completed. A dispersion test was carried out at ambient temperatures by storing the 40% m coal-diesel slurry in a 1 litre measuring cylinder at ambient temperatures. After 24 hours 50 ml samples of dispersed slurry were taken from the top, middle and bottom of the measuring cylinder and the coal concentration determined by filtration. Values for coal concentration of 34.7% m, 35.2% m and 40% m were obtained for the top, middle and bottom layers respectively. This showed that dispersions of microfine coal in diesel remain stable for at least 24 hours at ambient temperatures. The particle size distribution of the coal particles in the fuel oil cake was obtained by laser scattering using the dilution method described in Example 15.

Example 2—Dispersion of Microfine Coal in Fuel Oil May be Achieved Via High-Shear Mixing of Various Forms of Microfine Coal Dried microfine coal powder (e.g. coal samples 1, 3, 4b, 8 and 5 in Table 3) a dried pellet of microfine coal, or microfine coal mixed with hydrocarbon oil in the form of a cake, is de-agglomerated and dispersed in fuel oil using a high-shear mixer in a vessel and blended with an additive to aid dispersancy, if required. Optionally, the vessel may be fitted with an ultrasonic capability to induce cavitation to enhance de-agglomeration. Shear mixing is carried out either at ambient temperatures or for more viscous fuel oils at elevated temperatures typically up to 50° C. Suitable shear mixers are manufactured by Charles Ross & Son Co. 710 Old Willets Path, Hauppauge, N.Y. 11788, USA, Silverson Machines Inc., 355 Chestnut St., East Longmeadow, Mass. 01028, USA, and Netzsch-Feinmahltechnik.

This process will typically take place at: a distillation plant, oil depot or bunkering facility, power plant, or industrial process site. The resultant fuel oil/microfine coal dispersion may be stored in tanks with agitation and heating equipment, stable for several months at ambient temperatures, or for short periods at elevated temperatures. The product can also be delivered immediately to end-user's combustion equipment.

Example 3—Properties of Blends of Microfine Coal with Fuel Oil

Three fuel oils (two RFO samples and one marine distillate, i.e. marine diesel) have been blended with microfine coal samples with an additive to aid dispersancy and a set of analytical test results obtained for a range of specification parameters, see Table 4.

Four microfine coal samples derived from the same generic US low-volatile bituminous coal source were tested (samples 1, 3, 4b and 8), together with three samples of US high-volatile bituminous coals (samples 5, 6 and D), and one high-volatile bituminous coal from Colombia (sample F), and another from Australia (sample 7).

Characterisation tests of the coal samples are given in Table 3. The microfine coal samples differ primarily in terms of particle size and ash content:

Sample 1 is highest in ash content (8.5% m); Sample 4b has a slightly lower ash content (7.0% m) than sample 1;

Sample 3 has a lower ash content (4.5% m) than sample 1, and an average particle size of 6.2 μm (d50=7.0 μm);

Samples 8, 5, 6, D and F are much lower in ash content (1.4% m to 1.8% m);

Samples D and F have the largest size particles with d50 of 16 μm to 17 μm;

Samples 8 and 5 are the smallest size particles with d50 of 1.8 μm and 1.5 μm respectively.

Samples 6 and 7 have relatively small size particles with d50 of 3.4 μm and 3.2 μm respectively, but sample 7 has the lowest ash content (0.8% m) of all the samples.

Samples 1 and 3 were derived from the same low-volatile bituminous coal source, samples 5 and 6 from two different high-volatile bituminous coal sources, and the results of characterisation tests are given in Table 3. (n.a.=not yet available). All microfine coal samples, excepting D and F had >99% of particles below 20 μm in diameter. Sample 5 had the highest proportion (30% m) of microfine coal particles below 1 μm.

TABLE 3

Characterisation test results for microfine coal samples (n.d. = not determined)

| Sample No. | | | 1 | 3 | 4b | 8 | 5 | 6 | D** | F | 7 |
|---|---|---|---|---|---|---|---|---|---|---|---|
| Coal class | | | | Low volatile bituminous | | | | High volatile bituminous | | | High volatile bituminous |
| Country of Origin | | | | | | USA | | | | Colombia | Australia |
| Ash content | dry basis | % m | 8.5 | 4.5 | 7.0 | 1.6 | 1.5 | 1.8 | 1.4 | 1.5 | 0.8 |
| Calorific Value | dry basis | Btu/lb | 13,500 | 14,860 | 14,590 | 15,050 | 14,320 | 13,800 | 14,570 | 14,020 | 14,450 |
| Gross Specific Energy | | MJ/kg | n.d. | 34.6 | 33.6 | 35.0 | 33.3 | 32.1 | 33.9 | 32.6 | 33.6 |
| Volatile Matter | dry, ash-free basis | % m | n.d. | 21.9 | 19.9 | 19.8 | 35.1 | 34.6 | 38.0 | 39.8 | 32.6 |
| Sulphur | dry basis | | 0.9 | 1.0 | 0.2 | 0.9 | 1.4 | 0.9 | 0.6 | n.d. | 0.4 |
| Carbon | | | n.d. | 86.6 | 83.3 | 86.6 | 83.3 | n.d. | 80.0 | 79.1 | 84.5 |
| Hydrogen | | | | 4.8 | 4.1 | 4.5 | 5.2 | | 5.7 | 5.4 | 5.8 |
| Particle Size distribution* | Average diameter | μm | 8.5 | 6.2 | n.a. | 1.8 | 2.2 | 5.0 | n.d. | n.a. | n.d. |
| | d50 | | 5.8 | 7.0 | 3.2 | 1.8 | 1.5 | 3.4 | 16.5 | 16.8 | 3.2 |
| | d90 | | 12.0 | 14.2 | 8.0 | 4.3 | 5.1 | 12 | 86 | 71 | 6.7 |
| | d95 | | 14.6 | 16.8 | 11.1 | 5.8 | n.d. | n.d. | 117 | 90 | 7.8 |
| | d98 | | 17.3 | 21.2 | 39 | 9.6 | | | 153 | 111 | 9.0 |
| | d99 | | 20.0 | 26 | 58.1 | 17.5 | | | 176 | 125 | 10 |
| | <100 μm | %, vol | 100 | 100 | 99.99 | 100 | 100 | 100 | 94 | 98 | 100 |
| | <20 μm | | 99 | 98 | 99 | 99 | 100 | 99 | n.d | n.d. | n.d. |
| | <10 μm | | 82 | 80 | 95 | 98 | 99 | 87 | 40 | 62 | 100 |
| | <1 μm | | 7 | 1 | 11 | 23 | 30 | 13 | 2 | 2 | 8 |

*particle size distributions determined by laser dispersion: sample 3 in xylene, samples 4b, 5, 6, 7 and 8 in water, remainder in diesel

**Coals 2A-2E are size fractions prepared from coal D by different milling methods.

An increase, both in density and in viscosity is observed from addition of three microfine coal samples 3, 4b and 8, Table 4. Density increases more rapidly for sample 3>sample 4b>sample 8; which may be associated with changes in particle size. However, there is little difference in the rate of viscosity increase between samples 3 and 8, suggesting that reducing coal particle size from an average diameter of 6.2 μm to 1.8 μm has surprisingly little impact on viscosity. The viscosity increase for sample 4b is less than for the other two coals, and this may be attributable to the higher ash content of this coal.

A small increase in density is observed from addition of 10% m microfine coal sample 1 to the very heavy RFO-1 from 999.5 kg/cm$^3$ to 1026.9 kg/cm$^3$ at 15° C. (with analogous results obtained for density at 60° C.) and a corresponding small increase in viscosity from 881 to 1128 CSt @ 50° C.).

A very small, but detectable, increase in density is observed from addition of 1% m microfine coal sample 1 to marine diesel from 0.8762 g/cm$^3$ to 0.8769 g/cm$^3$ @ 15° C. (with analogous results obtained for density at 60° C.). A consistent corresponding increase in viscosity was not detectable.

FIGS. 3 and 2 also show the density and viscosity limits of various grades of marine RFO.

The impact of the density and viscosity increases from microfine coal addition correspond approximately to the difference in density and viscosity between adjacent grades of fuel oil (Tables 1a to 1c). It has been surprisingly found that the addition of 10% m microfine coal only changes the fuel oil grade to the next heaviest fuel oil grade. Thus RFO-II, which is an RMK 380 grade, becomes RMK 700 on addition of 5% m microfine coal 3 or 5% m microfine coal 8. As density exceeds 1010 kg/m$^3$ and viscosity exceeds 700 mm$^2$/s, the application of RFO-microfine coals to marine and stationary equipment becomes more limited and the rate that at which particular microfine coals increase density and viscosity may become more important than ash content in determining the maximum amount of microfine coal that can be accommodated in practice.

Although addition of microfine coal to RFO increases viscosity, unexpectedly and a positive finding is that the Pour Point of RFO was relatively unaffected by the addition of microfine coal, Table 3. Note that the repeatability and reproducibility of RFO Pour Point determination are 2.6° C. and 6.6° C. respectively, so a value of 3° C. or 9° C. is not significantly different to 6° C. Hence, neither samples 3 nor 4b significantly affected Pour Point at a concentration of 10% m. However, addition of 10% m and 15% m of the lowest particle size coal sample 8 did produce a slightly higher Pour Point of 12° C. Similarly the Pour Point of marine diesel was unaffected by the addition of 1% m microfine coal.

TABLE 4

Analytical test results for RFO, marine diesel and their blends with microfine coal (n.m. = not measureable, n.d. = not determined, all samples contain a fuel oil dispersant additive at low concentration)

| Test | Method | Units | RFO-III | | RFO-II | | | | | | RFO-I | | Marine Diesel | |
|---|---|---|---|---|---|---|---|---|---|---|---|---|---|---|
| Sample No. | | | None | None | 3 | | 4b | 8 | | | None | 1 | None | 1 |
| Coal Concentration | | % m | | | 5 | 10 | 10 | 5 | 10 | 15 | | 10 | | 1.0 |
| | | | | | | | Density | | | | | | | |
| 60° C. | ASTM D4052 | kg/m$^3$ | n.d. | | | | n.d. | | | | 970.0 | 997.6 | 845.3 | 846.0 |
| 15° C. | ASTM D4052 | | 986.3 | 989.9 | 1004.8 | 1018.1 | 1015.2 | 998.2 | 1012.7 | 1029.4 | 999.5 | 1026.9 | 876.2 | 876.9 |
| | | | | | | | Kinematic Viscosity | | | | | | | |
| 25° C. | ASTM D445 | cSt | n.d. | 2791 | | | | | | n.d. | | | | |
| 50° C. | | | 380 | 310 | 574 | 688 | 637 | 562 | 700 | 890 | 881 | 1128 | 2.905 | 2.909 |
| 100° C. | | | 44.2 | 35.7 | 44.9 | 56.3 | 54.0 | 47.8 | 58.3 | 79.7 | 60.2 | 104.4 | 1.359 | 1.356 |
| 120° C. | | | 19.1 | 20.2 | | | | | | n.d. | | | | |
| Sulphur | IP336 | % | 1.13 | 3.17 | | | | | | n.d. | | | | |
| Ash | ASTM D482 | % | <0.001 | <0.001 | | | | n.d. | | | | 1.43 | <0.001 | 0.022 |
| Pour Point | ASTM D97 | ° C. | 18 | 6 | 3 | 6 | 3 | 9 | 12 | 12 | 12 | 12 | −45 | −45 |
| Flashpoint | ASTM D93 | ° C. | 127 | 108 | 123 | 126 | n.d. | 120 | 121 | 132 | n.m. | 154 | 71 | 80 |
| Total Acid Number | ASTM D664 | mg KOH/g | <0.1 | 0.3 | 0.12 | 0.01 | | 0.03 | 0.35 | 0.26 | 0.782 | 0.791 | 0.031 | 0.035 |
| Copper Corrosion | ASTM D130 | rating | n.d. | n.d. | | | n.d. | | | | 1A | 1A | 1A | 1A |

Figure 4:
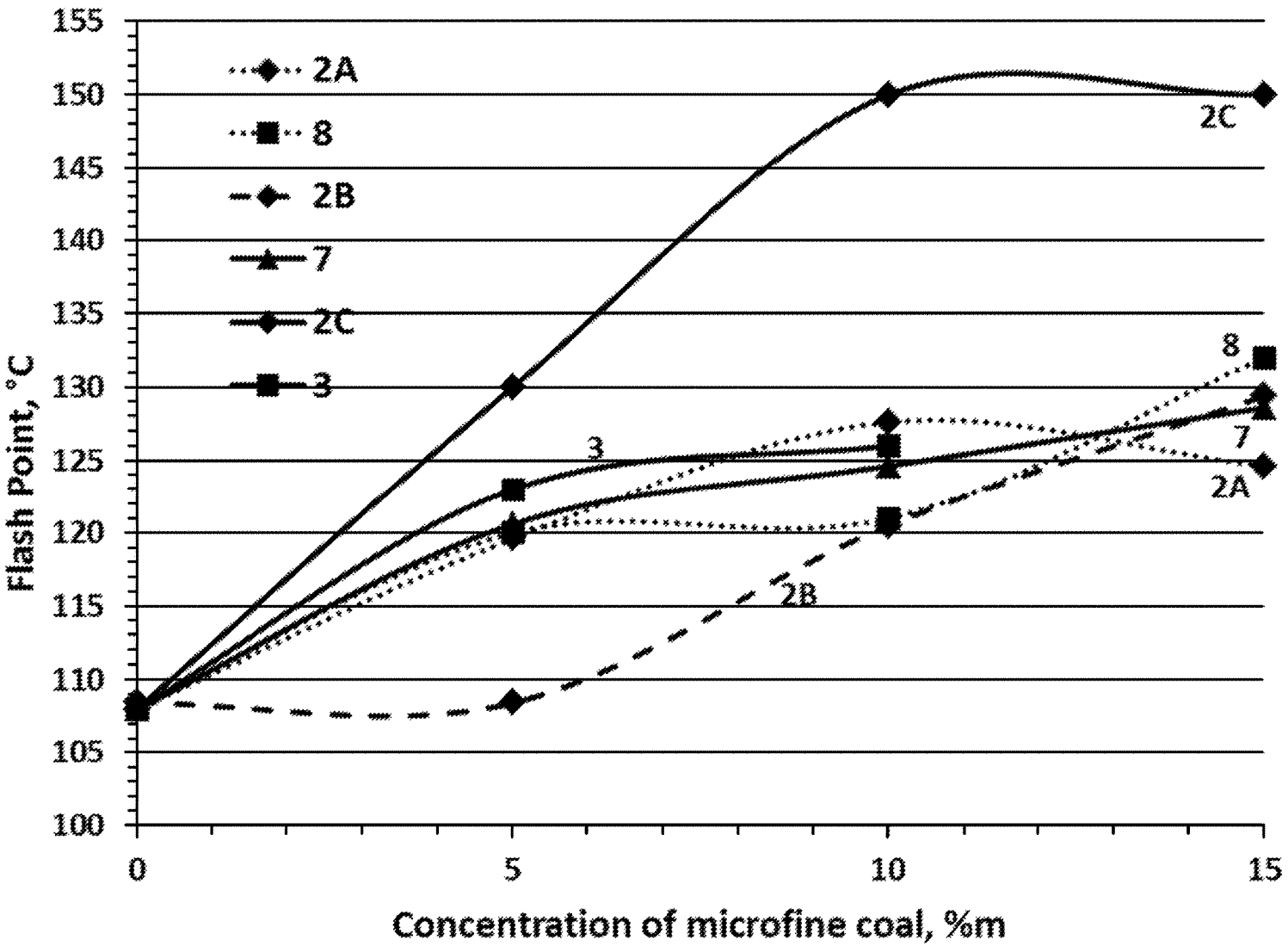
FIG. 4 shows the dependence of Flash Point on coal concentration for blends of RFO-II with different coal particle size fractions from low and high volatile bituminous coals

The Flash Point of RFO and marine diesel is improved (i.e. higher value) by blending microfine coal with the base fuel oil, Example 7 and FIG. 4. Addition of 5% m of coal samples 3 or 8 increased the Flash Point of RFO-II by 15° C. and 12° C. respectively, with a further increase in Flash Points demonstrated for concentrations of 10% m of coal samples 3 or 8 and 15% m of coal sample 8. Similarly, the Flash Point is improved by 9° C. by adding just 1% m of microfine coal sample 1 (not shown). This ability to manipulate the flashpoint of the blended coal-fuel oil may be useful in bringing the blend back into specification when the non-blended fuel oil falls outside. There are currently no fuel additives available commercially that can be used to adjust flash point in a predictable way. The ability to manipulate the flashpoint of the blended coal-fuel oil may be useful in bringing the blend back into specification when the non-blended fuel oil falls outside.

The total acid number (TAN), a measurement of RFO acidity, can be improved by addition of microfine coal, Example 8, albeit consistent improvement is not observed from all the blends tested. In neither case did TAN deteriorate from microfine coal addition. On the one hand Coal 3 progressively reduced the RFO-II TAN value from 0.3 to 0.12 to 0.01 mg KOH/g fuel as concentration was increased from 0 to 5% m to 10% m. However a marked reduction in TAN by coal 8 at 5% m addition from 0.3 to 0.03 mg KOH/g fuel was followed by values of 0.5 and 0.26 mg KOH/g fuel at 10% m and 15% m respectively which are commensurate with that for the base fuel alone.

Figure 2A:
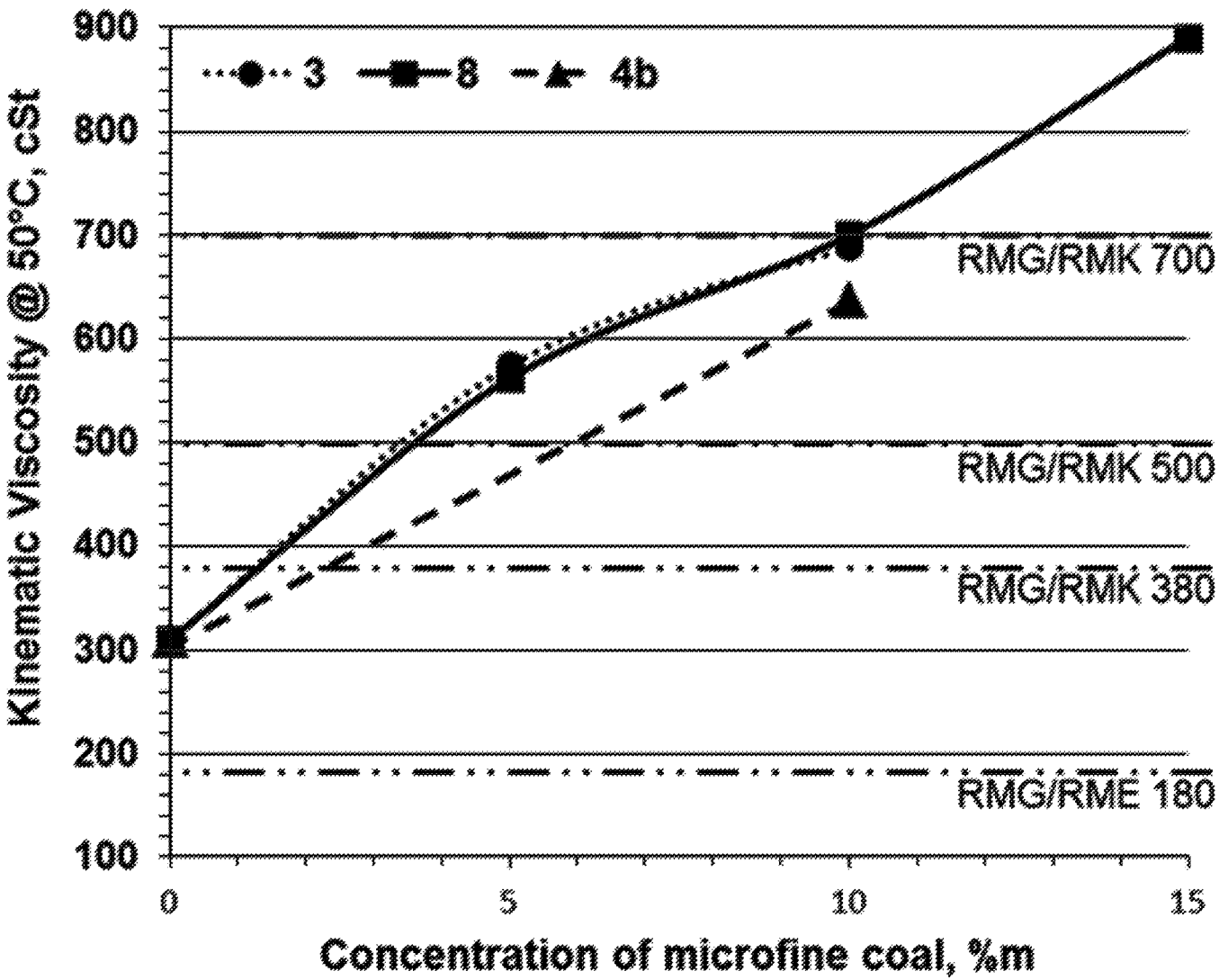
FIG. 2*a* shows the relationship between viscosity and microfine coal concentration for RFO-coal blends.
Figure 2B:
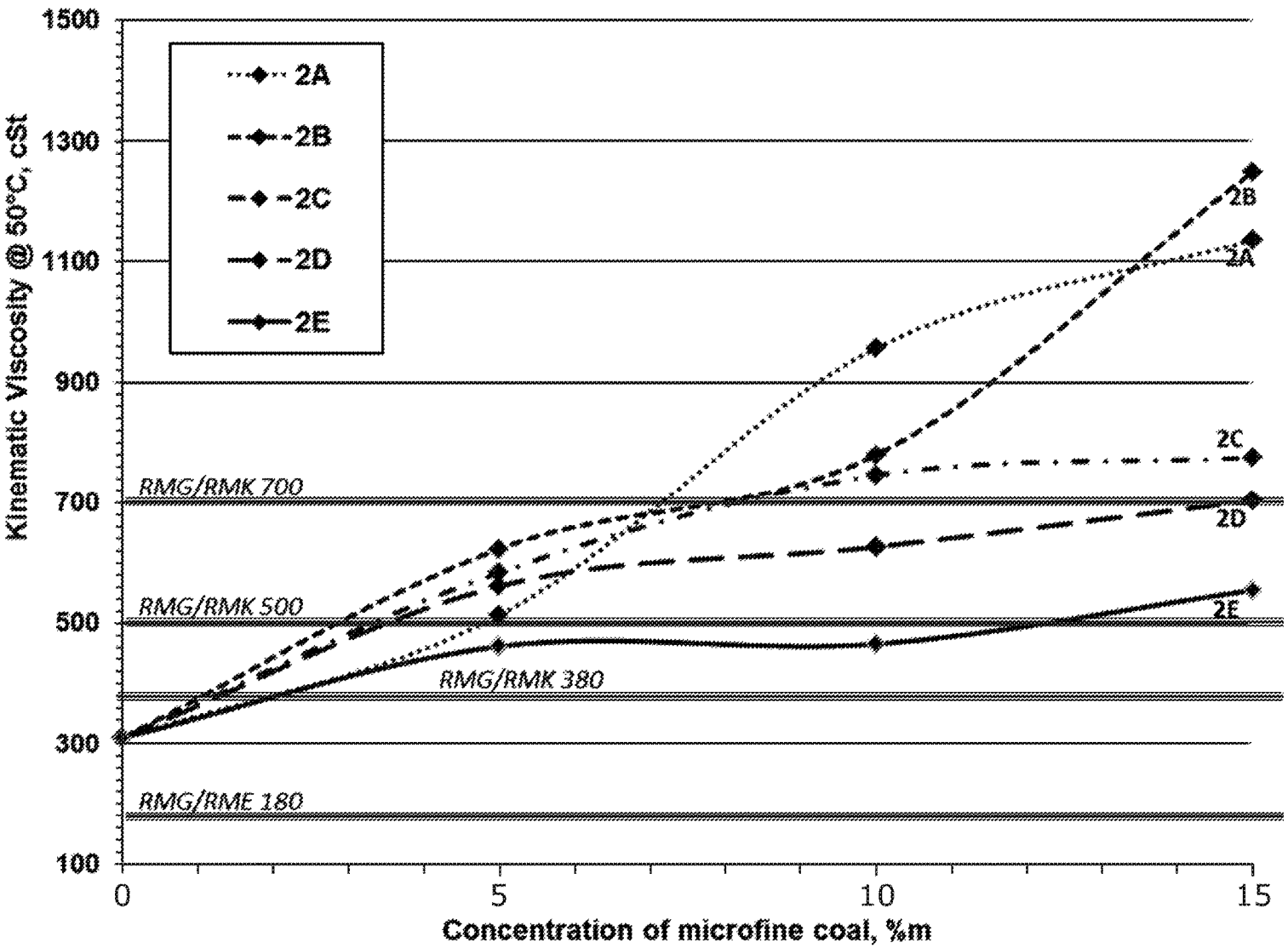
FIG. 2*b* shows the dependence of viscosity on coal concentration for blends of RFO-II with different coal particle size fractions from high-volatile bituminous coal D.

Example 4—Viscosity of RFO Blends with a High-Volatile Bituminous Coal of Different Particle Sizes RFO-II has been blended with 5 microfine coal samples of different particle size derived from coal D (samples 2A-2E) and viscosity measured for concentrations up to 15% m, Table 5 and FIGS. 2*a* and 2*b*. Table 3 gives the analytical details of all the main coals investigated hereon, including the parent coal D. As shown in FIG. 3, viscosity of RFO-II-coal blends increases as coal concentration increases, but there are markedly different rates of viscosity increase. In fact the differences in particle size have more impact on viscosity than the increasing coal concentration.

The rate of viscosity increase is least for coal 2E which in turn is less than 2D<2C<2B and 2A. This order coincides with most measures of particle size increasing in the order 2E>2D>2C>2B>2A. Thus viscosity increase of RFO-microfine coal blends is inversely proportional to particle size. It is worth noting that the viscosity-particle size traces for 2A and 2B crossover: although 2A has a lower d50 and d90 than 2B, and contains 35% of sub-1 μm particles, it contains less particles <10 μm than 2B and its d95, d98 and d99 values are higher.

TABLE 5

Viscosity results for RFO-II blended with different coal particle size fractions from high-volatile bituminous coal D.

| % coal in | Coal code (in order of increasing particle size) | | | | |
|---|---|---|---|---|---|
| RFO-II | 2A | 2B | 2C | 2D | 2E |
| | Kinematic viscosity @ 40° C. | | | | |
| 0 | 310 | 310 | 310 | 310 | 310 |
| 5 | 512 | 623 | 583 | 561 | 461 |
| 10 | 956 | 779 | 746 | 626 | 465 |
| 15 | 1136 | 1248 | 775 | 703 | 554 |
| | Particle size in μm | | | | |
| d50 | 1.3 | 2.7 | 4.0 | 6.9 | 16.5 |
| d90 | 4.4 | 6.7 | 15.1 | 21.1 | 86 |
| d95 | 12.5 | 8.3 | 16.7 | 28.3 | 117 |
| d98 | 81 | 10.2 | 51 | 41.4 | 153 |
| d99 | 128 | 11.4 | 95 | 61 | 176 |
| size | | | % | | |
| <100 μm | 99 | 100 | 99 | 99.93 | 94 |
| <10 μm | 94 | 98 | 83 | 70 | 40 |
| <1 μm | 35 | 14 | 7 | 4.5 | 2 |

FIGS. 2*a* and 2*b* also show the viscosity limits of some grades of marine RFO. The impact of the viscosity increase from microfine coal addition can correspond to the difference in viscosity between adjacent grades of fuel oil (Tables 1a to 1c). It has been surprisingly found that the addition of 5% m or 10% m microfine coal only an change the fuel oil grade to higher viscosity fuel oil grades. Thus RFO-II, which is an RMG 380 grade, becomes a 500 grade on addition of up to 10% m microfine coal 2E, and RFO-II becomes a 700 grade on addition of 5% m of 2B, 2C, 2D or 2E.

As the upper limit for RFO viscosity used in most ship is 700 cSt @ 50° C., and that for most stationary boilers is approximately 60 cSt @ 100° C. (e.g. RFO-I), viscosity increase will limit the highest coal concentration that can be used. Similarly as particle size in turn influence viscosity increase then particle size distribution becomes a critical factor for determining an acceptable concentration of microfine coal in RFO. Although sub-1 micron particles increase RFO viscosity more quickly when concentration is increased, a surprisingly high concentrations of sub-1 μm can be accommodated, e.g. with RFO-II a blend of approximately 8% m coal 2A, which contains as much as 35% sub-1 micron particles would be acceptable for marine use.

Example 5. Density of RFO Blends with Coals of Different Rank of Different Particle Sizes RFO-II has been blended with 3 microfine coal samples of different particle size derived from coal D (samples 2A-2E) and with coals 3, 4b, 7 and 8. Density was measured for concentrations up to 15% m, Table 6. As shown in FIG. 3, density of RFO-II-coal blends increases as coal concentration increases, but there is a wider range of rates of density increase.

In contrast to viscosity changes, the differences in particle size have less impact on density than the increasing coal concentration. The rate of density increase is least for coal 2E, is approximately the same for 2D and 2C, with that for coals 3, 7 and 8 the highest. This order is approximately in line with increasing particle size. Thus density increase of RFO-microfine coal blends is inversely proportional to particle size.

TABLE 6

Density results for RFO-II blended different coal particle size fractions from high volatile bituminous coals 2 and 7, and low-volatile bituminous coals 3, 4a and 8. (Particle size data for these coals is given in Tables 5 and 3).

| | Sample no. (in order of increasing particle size) | | | | | | |
|---|---|---|---|---|---|---|---|
| % coal in RFO-II | 2A | 8 | 2B | 7 | 4b | 2C | 3 |
| | Density @ 15° C., kg/m$^3$ | | | | | | |
| 0 | 989.9 | 989.9 | 989.9 | 989.9 | 989.9 | 989.9 | 989.9 |
| 5 | 992.9 | 998.2 | 1000.7 | 1008.0 | | 1000.6 | 1004.8 |
| 10 | 1003.8 | 1012.7 | | 1017.1 | 1015.2 | 1004.6 | 1018.1 |
| 15 | 1011.2 | 1029.4 | | 1024.4 | | 1020.6 | |

Figure 3A:
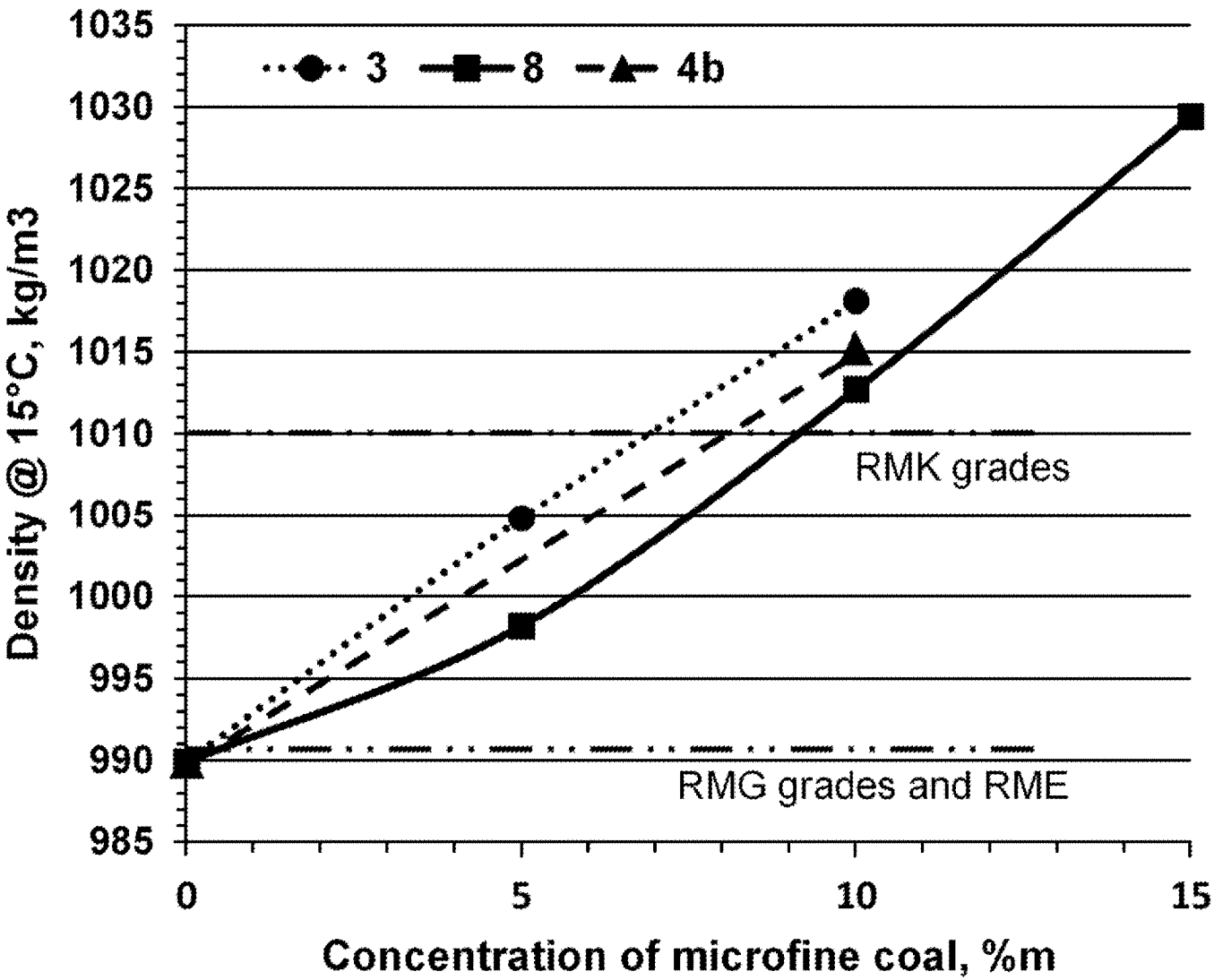
FIG. 3*a* shows the relationship between density and microfine coal concentration for RFO-coal blends.
Figure 3B:
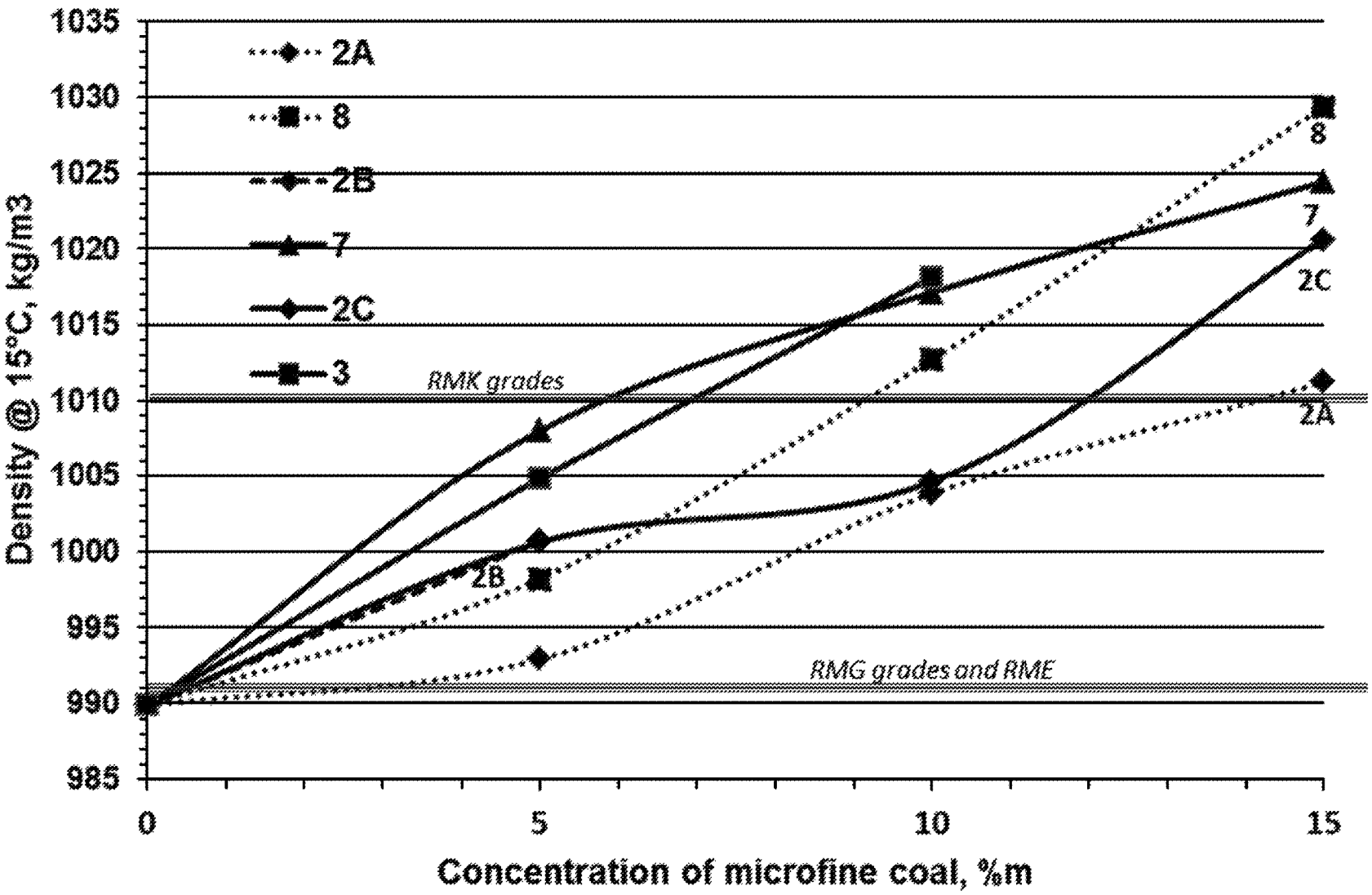
FIG. 3*b* shows the dependence of density on coal concentration for blends of RFO-II with different coal particle size fractions from low and high volatile bituminous coals.

FIGS. 3*a* and 3*b* also show the density limits of various grades of marine RFO. Just as with viscosity, the impact of the density increases from microfine coal addition can also correspond to the difference in density between adjacent grades of fuel oil (Tables 1a to 1c). It has again been surprisingly found that the addition of 10% m microfine coal only changes the fuel oil grade to a higher density fuel oil grade. Thus RFO-II, which is an RMG grade, becomes a RMK grade on addition of 5% m of any of the microfine coals 2A-2E.

The upper limit for RFO density used in most shipping is in practice 1250 kg/m$^3$ @ 15° C., which is determined by the upper operating limit for the most commonly used type of centrifuge (Alcap type). Some older fuel oil centrifuges have an upper operating limit of 1010 kg/m$^3$ @ 15° C. Stationary boiler fuel oil specifications do not usually include a maximum density requirement.

As density and viscosity increases, the application of RFO-microfine coals to marine and stationary equipment can become more limited and the rate that at which particular microfine coals increase both these parameters may become as important as ash content in determining the maximum amount of microfine coal that can be accommodated in practice.

Example 6. Pour Point of RFO Blends with Coals of Different Rank of Different Particle Sizes Pour Point was measured for RFO-II blends with a similar set of coals as that used for Example 5. The results are shown in Table 7. Although addition of microfine coal to RFO increases viscosity, the unexpected positive finding is that the Pour Point of RFO only increases by a small amount when microfine coal is added.

The repeatability and reproducibility of RFO Pour Point determination is 2.6° C. and 6.6° C. respectively, so a value of 3° C. or 9° C. is not significantly different to 6° C. Hence, neither samples 3 nor 2C significantly affected Pour Point at concentrations up to 10% m and 15% m respectively. However, addition of 10% m and 15% m of the coal samples 2A, 8, 2B and & 8 did produce a slightly higher Pour Point of 12° C. The latter four coal samples have smaller particle sizes than coals 2C and 3 indicating the Pour Point increase for RFO blends is greater for coals with the lowest particle size, which is consistent with higher viscosity increases observed for lower coal particle sizes at the same coal concentration, Example 4.

TABLE 7

Pour Point results for RFO-II blended different coal particle size fractions from high volatile bituminous coals 2 and 7, and low-volatile bituminous coals 3 and 8. (Particle size data for these coals is given in Tables 5 and 3).

| | Sample no. (in order of increasing particle size) | | | | | |
|---|---|---|---|---|---|---|
| % coal in RFO-II | 2A | 8 | 2B | 7 | 2C | 3 |
| | Pour Point, ° C. | | | | | |
| 0 | 6 | 6 | 6 | 6 | 6 | 6 |
| 5 | 9 | 9 | 6 | 6 | 6 | 3 |

TABLE 7-continued

Pour Point results for RFO-II blended different coal particle size fractions from high volatile bituminous coals 2 and 7, and low-volatile bituminous coals 3 and 8. (Particle size data for these coals is given in Tables 5 and 3).

| | Sample no. (in order of increasing particle size) | | | | | |
|---|---|---|---|---|---|---|
| % coal in RFO-II | 2A | 8 | 2B | 7 | 2C | 3 |
| | Pour Point, ° C. | | | | | |
| 10 | 12 | 12 | 9 | 12 | 9 | 6 |
| 15 | 12 | 12 | 12 | 12 | 6 | n.d. |

Example 7. Flash Point of RFO Blends with Coals of Different Rank of Different Particle Sizes In Example 3 it was discussed that the Flash Point of marine diesel and RFO could be improved (i.e. higher value) by a significant amount from blending microfine coal 1 with the base fuel, (Table 4). Flash Point was measured for RFO-II blends with a similar set of coals as that used for Example 6. The results are shown in Table 8 and FIG. 4.

TABLE 8

Flash Point results for RFO-II blended different coal particle size fractions from high volatile bituminous coals 2 and 7, and low-volatile bituminous coals 3 and 8. (Size data for these coals is given in Tables 3 and 5).

| | Sample no. (in order of increasing particle size) | | | | | |
|---|---|---|---|---|---|---|
| % coal in RFO-II | 2A | 8 | 2B | 7 | 2C | 3 |
| | Flash Point, ° C. | | | | | |
| 0 | 108 | 108 | 108 | 108 | 108 | 108 |
| 5 | 120 | 120 | 108 | 121 | 130 | 123 |
| 10 | 128 | 121 | 121 | 125 | 150 | 126 |
| 15 | 125 | 132 | 129 | 129 | 150 | n.d. |

In 5 of the 6 coal samples tested, addition of just 5% m of microfine coal increased the Flash Point of the RFO blend from by over 10° C. from 108° C. in RFO-II alone to over 120° C. Further coal additions of 10% m and 15% m to RFO-II increased Flash Point further to values of around 125° C. and 130° C. respectively. In one case, coal 2C, Flash Point was elevated to 150° C. by 10% m and 15% m addition (FIG. 4).

These are significant increases for a parameter that can be a limiting specification parameter in RFO refinery manufacturing. Being able to manipulate the flashpoint of the blended coal-fuel oil may be useful in bringing the blend back into specification when the non-blended fuel oil falls outside. To help with context, there are no fuel additives available commercially that can be used to adjust Flash Point in a predictable way.

Example 8. Total Acid Number of RFO Blends with Coals of Different Rank of Different Particle Sizes The total acid number (TAN), a measurement of RFO acidity, can be improved by addition of microfine coal, Table 9, albeit that consistent improvement is not observed from all the blends tested. On the one hand Coal 3 progressively reduced the RFO-II TAN value from 0.3 to 0.12 to 0.01 mg KOH/g fuel as concentration was increased from 0 to 5% m to 10% m. However a marked reduction in TAN by coal 8 at 5% m addition from 0.3 to 0.03 mg KOH/g fuel was followed by values of 0.35 and 0.26 mg KOH/g fuel at 10% m and 15% m respectively which are commensurate with that for the base fuel alone.

TABLE 9

Total Acid Number (TAN) for RFO-II blended different coal particle size fractions from high low-volatile bituminous coals 3 and 8. (Size data for these coals is given in Tables 3 and 5).

| % coal in | Sample no. | |
|---|---|---|
| RFO-II | 8 | 3 |
| | TAN, mgKOH/g | |
| 0 | 0.30 | 0.30 |
| 5 | 0.03 | 0.12 |
| 10 | 0.35 | 0.01 |
| 15 | 0.26 | n.d. |

Example 9. Dispersion Stability of RFO-Microfine Coal Blends

A stainless steel rig was designed for testing the dispersion of microfine coal samples in RFO, FIG. 4. Three ports were included to draw off samples @ 15, 30 & 45 cm above the base of the mixing vessel. The rig was preheated to 80° C., because the tested RFO was too viscous at 25° C. to disperse the microfine coal. Blends of 10% m air-dried microfine coal and RFO, plus a fuel oil dispersant additive were shear mixed at 8,000 to 9,000 rpm over different time intervals from 10 to 60 minutes, then left to stand at 80° C. for times between 1 hour and 7 days. Dispersed liquid was taken from each sampling port and filtered hot through a sinter to collect the solid material and the weight of solid material was weighed according to IP 375. The same concentration of solid in the top, middle & bottom samples is indicative of good dispersion. In some cases an additional measurement was made at the actual bottom of the mixing vessel. Results from a series of dispersion tests on blends of RFO II and coal sample 3 are given in Table 10.

The results demonstrate that dispersions of 10% m microfine coal in RFO can be produced. These dispersions are stable up to 48 hours if prepared by shear mixing with a dispersant additive for 60 minutes (test 8). Shorter stability times of 24 hours were obtained if only 10 minutes mixing was carried out (tests 1-4).

A blend of 1% m microfine coal and marine diesel, plus a fuel oil dispersant additive, was shear mixed at 11,000 rpm in a 100 ml glass sample bottle for 20 minutes, then left to stand at ambient temperature for 1 hour and 24 hours (test 12 and 13). This was then repeated in an ultrasonic bath (tests 14 and 15). After settling for 1 hr, a 10 mL aliquot of the fuel-coal particle suspension was taken by Eppendorf pipette from the top (first) and from the bottom (second) of the sample. Each aliquot was vacuum filtered through pre-weighed 0.8 μm cellulose nitrate membrane filters using a sintered glass Buchner flask. The solid residue+filter were washed four times with n-heptane before reweighing, after a minimum of 24 hrs drying time, to determine mass of undissolved solids in each aliquot and hence, uniformity of dispersion.

The results show that dispersions of 1% m microfine coal in marine diesel can be produced that are stable for at least 1 hour. A more uniform dispersion is obtained if shear mixing occurs in an ultrasonic bath.

TABLE 10

Dispersion testing results on blends of microfine coal with RFO and marine diesel (n.d. = not determined, all test nos., contain a fuel oil dispersant additive at low concentration) (numbers in bold signify that the dispersion has broken down)

| | RFO-II with 10% m microfine coal sample 3 | | | | | | | | Marine Diesel with 1% m microfine coal sample 1 | | | |
|---|---|---|---|---|---|---|---|---|---|---|---|---|
| Mixing time | 10 min | | | | 30 min | | 60 min | | 20 min | | | |
| Standing time | 60 min | 1 day | 2 days | 7 days | 1 hr | 1 hr | 1 day | 2 days | 1 hr | 24 hr | 1 hr | 24 hr |
| Special condition | None | | | | | | | | Ultrasonics | | | |
| Test number | 1 | 2 | 3 | 4 | 5 | 6 | 7 | 8 | 12 | 13 | 14 | 15 |
| | Sediment, % m | | | | | | | | | | | |
| Top | 9.6 | 9.7 | **0.2** | **0.2** | 9.2 | 10.4 | 9.1 | 9.2 | 0.76 | **0.15** | 0.80 | **0.19** |
| Middle | 9.4 | 9.2 | **2.5** | **0.4** | 9.1 | 10.2 | 9.3 | 9.0 | n.d. | | | |
| Bottom | 9.5 | 9.4 | **9.5** | **1.4** | 8.7 | 10.1 | 9.2 | 9.2 | 0.98 | **0.35** | 1.01 | **0.45** |
| Dead bottom | n.d. | n.d. | **26.0** | **29.2** | n.d. | n.d. | 10.3 | 11.1 | n.d. | | | |

Example 10. Dispersion Stability of Blends of RFO with Microfine Coal 3 with and without Dispersant Additive In Example 9 it was shown that dispersions of 10% m microfine coal in RFO can be produced, stable up to 48 hours at 80° C., if prepared by shear mixing with a dispersant additive for 60 minutes at 80° C. Further work using the same method as described in Example 9 has been carried out, Table, 11. Thus in Test No. 9, 10% m of coal 3 was dispersed and held at 80° C. for 2 days without dispersant additive. Test No. 8 was identical except for the presence of the dispersant additive. Both tests showed a stable dispersion with almost all (91-97% m) of the microfine coal suspended in the top, middle and bottom layers. However the dispersed coal concentrations (expressed as % of initial coal concentration) were slightly higher 95-97% m with dispersant present than without (91-94% m) showing that addition of this dispersant was improving dispersion stability.

The inclusion of a proprietary dispersant additive improves dispersion. Suitable fuel dispersant additives are manufactured by most petroleum fuel additive manufacturers, e.g. Innospec Ltd., Oil Sites Road, Ellesmere Port, Cheshire, CH65 4EY, UK; Baker Hughes, 2929 Allen Parkway, Suite 2100, Houston, Tex. 77019-2118, USA; BASF SE, 67056 Ludwigshafen, Germany.

Example 11. Dispersion Stability of Blends of RFO with Microfine Coal 3 for Longer Periods The dispersion stability at 80° C. of 10% m microfine coal 3 in RFO-II after shear mixing for 60 minutes at 80° C. in the presence of a dispersant additive was tested for longer periods of 4 days and 7 days, see Test nos. 10 and 11, Table 11.

Excellent stability was obtained after 4 days with almost all (97-102% m) of the microfine coal suspended in the top, middle and bottom layers, Test 10. Note that because of experimental errors in the dispersion and the measurement of dispersed coal, values slightly above 100% m have been reported for several blends. Unless these values above 100% m appertain to the dead bottom layer where particles start to settle out when the dispersion breaks down, they should be treated as not significantly different in magnitude to 100% m.

TABLE 11

Additional dispersion testing results on blends of microfine coal with RFO-II and RFO-III (numbers in bold signify that the dispersion has broken down, all test nos., except test no. 9, contain a fuel oil dispersant additive at low concentration)

| | RFO-II | | | | RFO-III | | | | | |
|---|---|---|---|---|---|---|---|---|---|---|
| Coal Code | 3 | | | | 2B | | | | 7 | 8 |
| Concentration, % m | 10 | | | | 10 | 15 | 20 | 30 | 15 | 15 |
| Mixing time | 60 min | | | | | | | | | |
| Standing time | 2 days | | 4 days | 7 days | 4 days | | | | | |
| Test number | 8 | 9 | 10 | 11 | 16 | 17 | 18 | 19 | 20 | 21 |
| | Dispersed coal concentration, % m | | | | | | | | | |
| Top | 9.2 | 8.5 | 8.3 | 7.3 | 9.8 | 14.9 | 17.7 | 23.9 | 10.5 | 14.3 |
| Middle | 9.0 | 8.5 | 8.8 | 7.2 | 11.3 | 16.9 | 22.0 | 25.6 | 15.3 | 16.5 |
| Bottom | 9.2 | 8.3 | 8.5 | 7.2 | 11 | 16.5 | 22.5 | 25.7 | 15.5 | 16.1 |
| Dead bottom | 11.1 | 11.0 | 12.1 | n.d. | 12 | 19.2 | 22.0 | 37.9 | 18.5 | 16.0 |
| | Dispersed coal concentration, % m of initial concentration | | | | | | | | | |
| Top | 97 | 94 | 97 | 81 | 100 | 99 | 90 | 81 | 70 | 95 |
| Middle | 95 | 94 | 102 | 80 | 115 | 113 | 112 | 87 | 102 | 109 |
| Bottom | 97 | 91 | 99 | 80 | 112 | 110 | 114 | 87 | 103 | 107 |
| Dead bottom | 121 | 141 | n.d. | n.d. | 122 | 128 | 112 | 129 | 123 | 106 |

In Test 11 the dispersion experiment was extended to 7 days at 80° C. In this case relatively good stability was still obtained with most (80-81% m) of the microfine coal suspended in the top, middle and bottom layers. These two tests show that these dispersions have excellent stability beyond 4 days with a small amount of settlement beginning to occur after 7 days.

Once these dispersions of coal in RFO-II have been prepared in the rig (FIG. 1) at 80° C., they are cooled to ambient temperatures in a semi-gelatinous state and have been stored as stable dispersions for over a year.

Example 12. Dispersion Stability of Blends of RFO with Microfine Coals Covering a Range of Different Coal Concentrations Up to 30% m The dispersion stability at 80° C. of different concentrations of microfine coal 2B (10% m to 30% m) in RFO-III (for analytical details, see Table 5) has been measured after shear mixing for 60 minutes at 80° C. and storage at 80° C. for a period of 4 days, see Test nos. 16-19, Table 11. Excellent stability was obtained at 10% m, 15% m and 20% m where almost all (90→100% m, note comment in Example 10) of the microfine coal is suspended in the three main layers. The stability of a 30% m blend of coal 2B in RFO-III was also good (81-87% m 90→100% m of the microfine coal is suspended in the top, middle and bottom layers) with just a small amount of settlement occurring at the dead bottom.

Example 13. Dispersion Stability of Blends of RFO with Microfine Coals Covering a Range of Different Coal Rank and Particle Size The dispersion stability at 80° C. of 15% m of microfine coals 7 and 8 in RFO-III has been measured after shear mixing for 60 minutes at 80° C. and storage at 80° C. for a period of 4 days, see Test nos. 20-21, Table 11. Excellent stability was obtained for the blend of 15% m of coal 8, where almost all (95→100% m, note comment in Example 10) of the microfine coal is suspended in the three main layers. The stability of the 15% coal 7 blend is good, but there is evidence of small settlement in the dead bottom layer (129% m), compared with 70% m in the top layer, with 100% m in the middle and bottom layers. That the particle size of coal 8 (d50=1.8 μm) is lower than that of coal 2B (d50=2.7 μm) and of coal 7 (d50=3.2 μm) may provide an explanation for the better stability performance observed for coals 8 and 2B than coal 7.

Example 14. Combustion Characteristics of RFO Blends with Different Concentrations of a High-Volatile Coal of Very Low Ash Content The combustion properties of blends of RFO-III with different concentrations of coal 7 between 5% m and 15% m have been determined by the Standard Institute of Petroleum (London) Method IP541, Quantitative determination of ignition and combustion characteristics of residual fuels for use in compression ignition engines. In this method, a small sub-sample is injected into compressed air in a constant volume combustion chamber and the start of injection and pressure changes during each combustion cycle detected. This is repeated 25 times and ignition and combustion characteristics are calculated from the averaged pressure-time and rate of pressure change-time traces.

TABLE 12

Ignition and combustion characteristics of blends of RFO-III with coal 7

| Ignition and combustion characteristics | Units | Range applicable to conventional RFO | | RFO-III | RFO-III/coal blends (percentage of coal 7 below) | | |
|---|---|---|---|---|---|---|---|
| | | Min | Max | | 5% m | 10% m | 15% m |
| Estimated Cetane No. | | 12 | n.a. | 29.5 | 22.9 | 19.5 | 15.8 |
| Ignition Delay | ms | 2.7 | 7.6 | 5.2 | 5.6 | 5.7 | 6.0 |
| Main Combustion Delay | ms | 3.1 | 9.7 | 5.8 | 6.6 | 7.2 | 7.9 |
| End of Main Combustion | ms | 9.6 | 18.9 | 10.4 | 12.3 | 13.9 | 15.8 |
| End of Combustion | ms | 15.3 | 28.6 | 14.7 | 20.2 | 22.4 | 25.0 |
| Pre-Combustion Period | ms | 0.28 | 2.06 | 0.6 | 1.1 | 1.5 | 2.0 |
| Main Combustion Period | ms | 3.6 | 9.3 | 4.6 | 5.7 | 6.7 | 7.9 |
| After Burning Period | ms | 5.3 | 9.7 | 4.3 | 7.9 | 8.5 | 9.2 |
| Max ROHR Level | bar/ms | 1.1 | 4.8 | 2.6 | 1.9 | 1.4 | 1.1 |
| Position of Max ROHR | ms | 3.1 | 11.8 | 6.7 | 7.9 | 8.8 | 9.7 |

Table 12, shows the various ignition and combustion characteristics and the range applicable to conventional RFO for each of them. Blends from 5% m to 15% m of coal 7 in RFO-III are within these applicable will depend on the choice of base RFO, the coal type and the coal particle size, as well as the coal concentration. This pass data shows that such RFO-coal blends would perform well in normal large, low- and medium-speed, marine diesel engines.

Example 15. Particle Size Distribution in Dispersed RFO-Microfine Coal Blends

Figure 5:
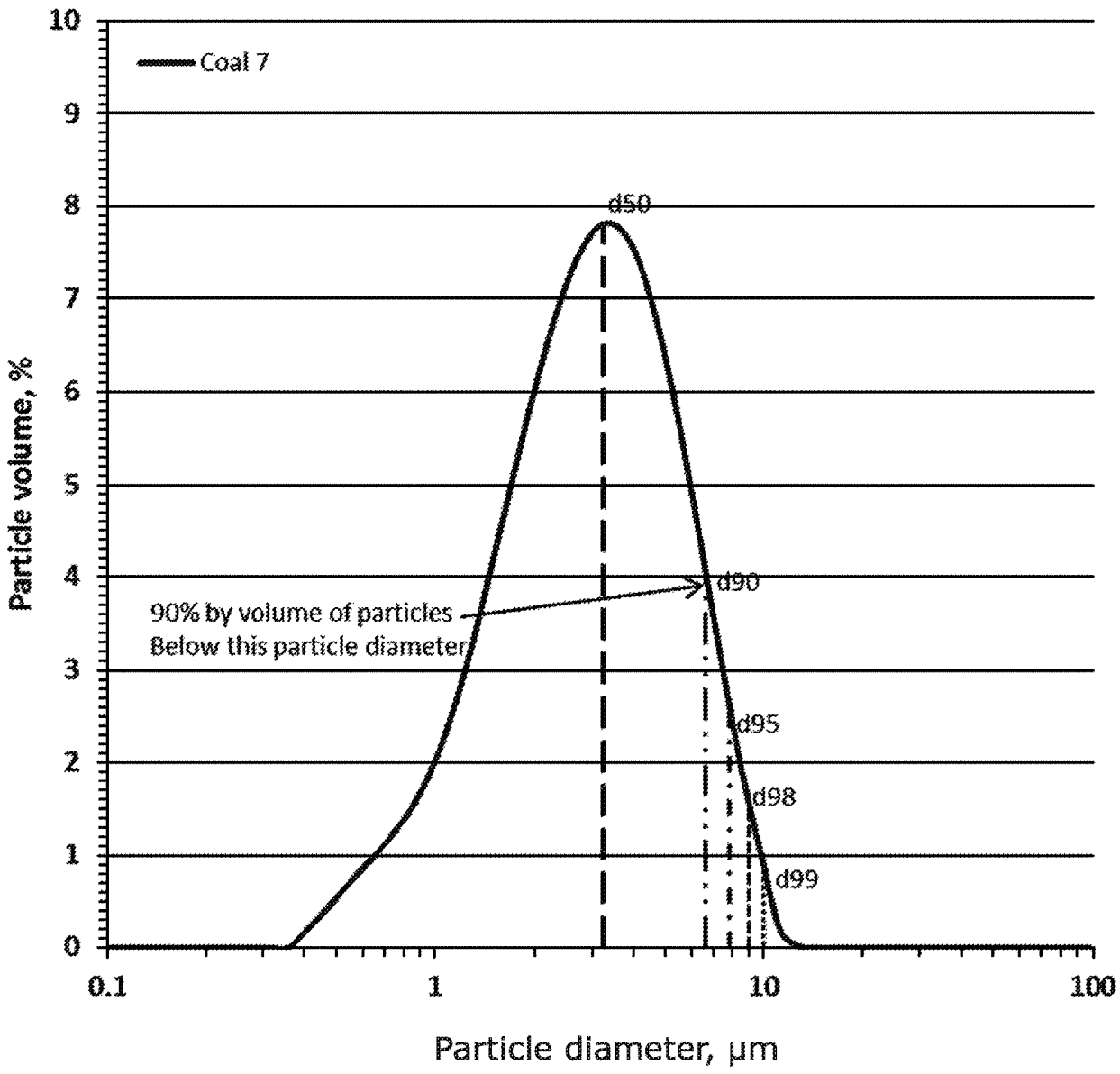
FIG. 5 shows the particle size distribution of coal 7 determined by laser scattering showing the characteristic size parameters: d50, d90, d95, d98 and d99.

Particle size distributions are typically determined by a laser scattering method which measures the particle volume of particles between a series of incremental size ranges. FIG. 5 illustrates the particle size distribution of coal 7. Above a particle size of 63 μm it is possible practically to separate coal into different size fractions by sieving, thus coal sample 6 was prepared between the two sieve sizes 63 μm and 125 μm, Table 3.

Typically the particle distribution width is quantified by particle diameter values on the x-axis, d50, d90, d95, d98 and d99, as shown in FIG. 5. d50 is defined as the diameter where half of the population lies below this value. Similarly, ninety percent of the distribution lies below the d90, ninety-five percent of the population lies below the d95, ninety-eight percent of the population lies below the d98 and ninety-nine percent of the population lies below the d99 value.

In view of the above, it has been surprisingly found that it is possible to engineer coal fines to obtain sufficiently low mineral matter content (or ash content), moisture content, sulphur content and particle size in order to meet those fuel oil specifications, and which also could be dispersed in fuel oil to provide a dispersion that is stable over at least 48 hours. Furthermore, preparation of a stable, if relatively short term, suspension of fine coal particles with a 1.0% m coal loading in Marine Fuel, which is much less viscous than RFO. The improvement in Flash Point of marine diesel as a result of blending in 1% m microfine coal was also unexpected.

Based on the above results, the present invention shows industrial application in:

- Upgrading coal fines so that at blend proportions up to 30% m in fuel oil, the resultant blend of fuel oil and microfine coal appears suitable to use for blends that would meet the limits of the main properties (such as ash, water, density, viscosity and calorific value) in the fuel oil specification.
- Reducing fuel oil sulphur content for those grades of fuel oil where fuel oil sulphur content exceeds that of microfine coal.
- A way of increasing fuel oil density and viscosity, e.g. addition of approximately 10% m microfine coal can change the fuel oil grade to the next heaviest fuel oil grade.
- Reducing use of fuel oil by introducing a lower cost blend component, yet providing equivalent performance.
- The improvement in Flash Point of marine diesel and RFO as a result of blending in microfine coal.

Although particular embodiments of the invention have been disclosed herein in detail, this has been done by way of example and for the purposes of illustration only. The aforementioned embodiments are not intended to be limiting with respect to the scope of the invention. It is contemplated by the inventors that various substitutions, alterations, and modifications may be made to the invention without departing from the spirit and scope of the invention.

The invention claimed is:

1. A process for the preparation of a fuel oil composition comprising combining a particulate material, wherein at least about 90% v of the particles within the material are no greater than about 20 microns in diameter; and a liquid fuel oil, wherein the particulate material is present in an amount of at most about 30% m based on the total mass of the fuel oil composition;

wherein the particulate material comprises coal, wherein the coal comprises sedimentary mineral-derived solid carbonaceous material selected from hard coal, anthracite, bituminous coal, sub-bituminous coal, brown coal, lignite or combinations thereof; wherein the particulate material comprises less than 5% m of ash content, wherein the liquid fuel oil is selected from one of the group consisting of: marine diesel; diesel for stationary applications; kerosene for stationary applications; marine bunker oil; residual fuel oil; and heavy fuel oil, and wherein the total water content of the fuel oil composition is less than 2% m.

2. The process of claim 1, wherein the particulate material is dispersed in the liquid fuel oil.

3. The process of claim 2, wherein the dispersion is achieved by a method selected from the group consisting of: high shear mixing; ultrasonic mixing, or a combination thereof.

4. The process of claim 1, wherein the particulate material is de-watered prior to combination with the liquid fuel oil.

5. The process of claim 1, wherein the particulate material is subject to de-mineralising prior to combination with the liquid fuel oil.

6. The process of claim 5, wherein the particulate material is demineralised via froth flotation techniques.

7. The process of claim 1, wherein the particulate material is subjected to a particle size reduction step.

8. The process of claim 7, wherein the particle size reduction is achieved by a method selected from the group consisting of: milling, grinding, crushing, high shear grinding or a combination thereof.

9. The process of claim 1, wherein the liquid fuel oil conforms to the main specification parameter included in one or more of the fuel oil standards selected from the group consisting of: ISO 8217:2010; ISO 8217:2012; ASTM D396; ASTM D975-14; BS 2869:2010, GOST10585-99, GOST10585-75 and equivalent Chinese standards.

10. A method for changing the grade of a liquid fuel oil comprising adding to the fuel oil a particulate material, wherein the material is in particulate form, and wherein at least about 90% v of the particles are no greater than about 20 microns in diameter, wherein the particulate material comprises coal, wherein the coal comprises sedimentary mineral-derived solid carbonaceous material selected from hard coal, microfine coal, anthracite, bituminous coal, sub-bituminous coal, brown coal, lignite or combinations thereof; wherein the particulate material comprises less than 5% m of ash content, and wherein the liquid fuel oil is selected from one of the group consisting of: marine diesel; diesel for stationary applications; kerosene for stationary applications; marine bunker oil; residual fuel oil; and heavy fuel oil, and wherein the total water content of a mixture of the liquid fuel oil and the particulate material is less than 2% m.

11. The method of claim 10, wherein the grade of the liquid fuel oil conforms to the main specification parameter included in one or more of the fuel oil standards from the group consisting of: ISO 8217:2010; ISO 8217:2012; ASTM D975-14; ASTM D396; BS 2869:2010, GOST10585-99, GOST10585-75 and equivalent Chinese standards.

12. A method of adjusting the flash point of a liquid fuel oil, wherein the method comprises combining a liquid fuel oil with particulate material, wherein the fuel oil is selected from the group consisting of: marine diesel; diesel for stationary applications, kerosene for stationary applications, marine bunker oil; residual fuel oil; and heavy fuel oil wherein at least about 90% v of the particles within the material are no greater than about 20 microns in diameter, wherein the particulate material comprises coal, wherein the coal comprises sedimentary mineral-derived solid carbonaceous material selected from hard coal, microfine coal, anthracite, bituminous coal, sub-bituminous coal, brown coal, lignite or combinations thereof; and wherein the particulate material comprises less than 5% m of ash content, wherein the total water content of a mixture of the liquid fuel oil and the particulate material is less than 2% m.

13. The process of claim 1, wherein the particulate material comprises microfine coal.

14. The process of claim 1, wherein at least 95% v of the particles are no greater than about 20 microns in diameter.

15. The process of claim 13 wherein the microfine coal comprises an ash content of less than about 1% m.

16. The process of claim 1, wherein the fuel oil composition conforms to main specification parameters included in one or more of the fuel oil standards selected from the group consisting of: ISO 8217:2010; ISO 8217:2012; ASTM D975-14; ASTM D396; BS 2869:2010, GOST10585-99, GOST10585-75 and equivalent Chinese standards.

17. The process of claim 1, wherein the particulate material is present in an amount of at least about 0.01% m to at most about 20% m based on the total mass of the fuel oil composition.

18. The process of claim 2, wherein the dispersion is stable for at least 24 hours.

19. The process of claim 1, wherein the fuel oil composition comprises a dispersant additive.

20. A process for the preparation of a fuel oil composition comprising: combining a particulate material, wherein at least about 90% v of the particles within the material are no greater than about 20 microns in diameter; and a liquid fuel oil, wherein the particulate material is present in an amount of at most about 30% m based on the total mass of the fuel oil composition; wherein the particulate material comprises coal, wherein the total water content of the fuel oil composition is less than 2% m and wherein the particulate material comprises less than 5% m of ash content.

21. The process of claim 20, wherein the particulate material is present in an amount of at least about 0.01% m to at most about 20% m based on the total mass of the fuel oil composition.

22. The process of claim 20, wherein the particulate material comprises microfine coal.

23. The process of claim 20, wherein the particulate material is dewatered prior to combination with the liquid fuel oil.

24. The process of claim 20, wherein the liquid fuel oil is selected from the group consisting of: marine diesel; diesel for stationary applications; kerosene for stationary applications; marine bunker oil; residual fuel oil; and heavy fuel oil.

25. The process of claim 20, wherein the liquid fuel oil conforms to main specification parameters included in one or more of the fuel oil standards selected from the group consisting of: ISO 8217:2010; ISO 8217:2012; ASTM D975-14; ASTM D396; BS 2869:2010, GOST10585-99, GOST10585-75 and equivalent Chinese standards.

26. A process for the preparation of a fuel oil composition comprising: combining a particulate material, wherein at least about 90% v of the particles within the material are no greater than about 20 microns in diameter; and a liquid fuel oil, wherein the liquid fuel oil is selected from the group consisting of: marine diesel; diesel for stationary applications; kerosene for stationary applications; marine bunker oil; residual fuel oil; and heavy fuel oil; and wherein the particulate material comprises coal, wherein the particulate material comprises less than 5% m of ash content, and wherein the total water content of the fuel oil composition is less than 2% m.

27. The process of claim 26, wherein the particulate material is present in an amount of at least about 0.01% m to at most about 20% m based on the total mass of the fuel oil composition.

28. The process of claim 26, wherein the particulate material comprises microfine coal.

29. The process of claim 28, wherein the microfine coal comprises an ash content of less than about 1% m.

30. The process of claim 26, wherein at least 95% v of the particles are no greater than about 20 microns in diameter.

31. The process of claim 26, wherein the particulate material is dewatered prior to combination with the liquid fuel oil.

32. The process of claim 26, wherein the liquid fuel oil conforms to main specification parameters included in one or more of the fuel oil standards selected from the group consisting of: ISO 8217:2010; ISO 8217:2012; ASTM D975-14; ASTM D396; BS 2869:2010, GOST10585-99, GOST10585-75 and equivalent Chinese standards.

* * * * *